US007527264B2

(12) United States Patent
Terada

(10) Patent No.: US 7,527,264 B2
(45) Date of Patent: May 5, 2009

(54) IMAGE RECORDING APPARATUS HAVING CONVEYING DEVICE FOR CONVEYING RECORDING MEDIUM

(75) Inventor: Kohei Terada, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 208 days.

(21) Appl. No.: 11/529,898

(22) Filed: Sep. 28, 2006

(65) Prior Publication Data

US 2007/0069457 A1 Mar. 29, 2007

(30) Foreign Application Priority Data

Sep. 28, 2005 (JP) ..... 2005-283000

(51) Int. Cl.
*B65H 5/02* (2006.01)

(52) U.S. Cl. ..... 271/274; 271/273; 271/272

(58) Field of Classification Search ..... 271/273, 271/272, 264, 274
See application file for complete search history.

(56) References Cited

U.S. PATENT DOCUMENTS

| | | | | |
|---|---|---|---|---|
| 2,974,952 | A * | 3/1961 | Zeuthen | 271/242 |
| 4,502,804 | A * | 3/1985 | Willcox | 400/641 |
| 4,550,902 | A * | 11/1985 | Godlewski | 271/10.02 |
| 4,611,939 | A * | 9/1986 | Fujiwara | 400/637 |
| 5,426,497 | A * | 6/1995 | Morganti et al. | 399/394 |
| 5,760,926 | A * | 6/1998 | Howard et al. | 358/498 |
| 6,644,875 | B1 * | 11/2003 | Sakaino et al. | 400/579 |
| 6,722,649 | B2 * | 4/2004 | Yui | 271/184 |
| 7,066,463 | B2 * | 6/2006 | Zembko et al. | 271/272 |
| 7,222,955 | B2 * | 5/2007 | Ohashi et al. | 347/104 |
| 2001/0054792 | A1 * | 12/2001 | Kato et al. | 271/272 |
| 2003/0161674 | A1 | 8/2003 | Nemoto | |
| 2005/0067775 | A1 * | 3/2005 | Ono | 271/272 |
| 2005/0083395 | A1 | 4/2005 | Kubota et al. | |
| 2007/0069456 | A1 * | 3/2007 | Jeong | 271/272 |
| 2008/0042340 | A1 * | 2/2008 | Linder et al. | 271/274 |

FOREIGN PATENT DOCUMENTS

| | | | |
|---|---|---|---|
| DE | 3545304 | A1 * | 7/1987 |
| EP | 436404 | A2 * | 7/1991 |
| JP | 55041569 | * | 3/1980 |
| JP | 500-4396 | | 1/1993 |
| JP | 2000-211775 | | 8/2000 |
| JP | 2000211775 | * | 8/2000 |
| JP | 2000211775 A | * | 8/2000 |

* cited by examiner

*Primary Examiner*—Patrick H Mackey
*Assistant Examiner*—Patrick Cicchino
(74) *Attorney, Agent, or Firm*—Reed Smith LLP

(57) ABSTRACT

A conveying device of an image recording apparatus includes a drive roller, a follow roller, an urging member, a bearing member, a pivoting support member, and a driving unit. The urging member applies pressure to the follow roller for pressing the follow roller against the drive roller. The bearing member supports the urging member and rotatably supports the follow roller. The pivoting support member supports the bearing member such that the bearing member is pivotally movable about either one of a rotational axis of the drive roller and another axis different from the rotational axis. The driving unit pivotally moves the pivoting support member and the bearing member between a first position at which the follow roller is located on a conveying path for conveying a recording medium and a second position at which the follow roller is retracted from the conveying path.

12 Claims, 17 Drawing Sheets

IMAGE RECORDING APPARATUS HAVING CONVEYING DEVICE FOR CONVEYING RECORDING MEDIUM

CROSS REFERENCE TO RELATED APPLICATIONS

This application claims priority from Japanese Patent Application No. 2005-283000 filed Sep. 28, 2005. The entire content of the priority application is incorporated herein by reference.

TECHNICAL FIELD

The disclosure relates to an image recording apparatus provided with a conveying device including a drive roller, and a follow roller that contacts the drive roller with pressure for conveying a sheet-like recording medium to an image recording position.

BACKGROUND

One conventional inkjet type image recording apparatus disclosed in Japanese patent application publications Nos. 2000-211775 and HEI-5-4396 includes a paper cassette; a paper-conveying path; and a pair of conveying rollers and a pair of discharge rollers disposed along the paper-conveying path for conveying a recording paper from the paper cassette along the paper-conveying path. The image recording apparatus also includes a platen disposed on the paper-conveying path, a carriage that can be slidingly moved in a direction orthogonal to a conveying direction for conveying the recording paper, and a recording head mounted in the carriage so as to confront the platen. In the image recording apparatus having this construction, the recording paper is conveyed intermittently over the platen by predetermined steps, while the carriage conveys the recording head, and the recording head ejects ink from nozzles therein onto the recording paper, thereby recording an image by predetermined regions.

A controller controls the rotations of the conveying rollers disposed upstream of the platen in the paper-conveying direction and the discharge rollers disposed downstream of the platen in the paper-conveying direction in order to convey the recording paper intermittently. The conveying rollers are configured of a drive roller that is driven to rotate by a rotational force transmitted from a motor or the like, a follow roller, and coil springs that urge the follow roller to contact the drive roller with pressure.

A conventional cam mechanism for moving the follow roller includes an arm supported at a support point in the approximate center thereof, and an eccentric cam. One end of the arm is coupled to the rotational shaft of the follow roller, while the other end is operated by the eccentric cam driven by a motor or the like. The arm moves the follow roller up and down using the principle of the lever.

SUMMARY

However, the above-described conventional cam mechanism must use a large motor for generating sufficient torque to compress the coil springs, requiring that sufficient space be allocated for the motor. Further, while it is conceivable to drive the motor at a slower speed or to use a reduction gear for outputting this torque, an operation to lower the follow roller with this construction requires more time. Since an independent motor is also required for driving the eccentric cam, there is not only an increase in mechanical components such as motors and transmission mechanisms, but also an increase in control circuits required for controlling the motors, thereby increasing the scale of the device and leading to a more complex circuit structure. Further, use of motors and reduction gears generates noise.

In view of the foregoing, it is an object of one aspect of the invention to provide an image recording apparatus capable of retracting a conveying device from a conveying path when conveying a recording medium in reverse through a simple structure.

In order to attain the above and other objects, according to one aspect, the invention provides an image recording apparatus. The image recording apparatus includes a main body, an image recording unit, and a conveying device. The main body is formed with a conveying path along which a recording medium is conveyed. The image recording unit records an image on the recording medium at an image recording position. The conveying device conveys the recording medium to the image recording position. The conveying device includes a drive roller, a follow roller, an urging member, a bearing member, a pivoting support member, and a driving unit. The drive roller is rotatable about a rotational axis. The follow roller is in pressure contact with the drive roller. The urging member applies pressure to the follow roller for pressing the follow roller against the drive roller. The bearing member supports the urging member and rotatably supports the follow roller. The pivoting support member supports the bearing member such that the bearing member is pivotally movable about either one of the rotational axis and another axis different from the rotational axis. The driving unit pivotally moves the pivoting support member and the bearing member between a first position at which the follow roller is located on the conveying path for conveying the recording medium and a second position at which the follow roller is retracted from the conveying path.

BRIEF DESCRIPTION OF THE DRAWINGS

Illustrative aspects in accordance with the invention will be described in detail with reference to the following figures wherein.

Figure 17A:
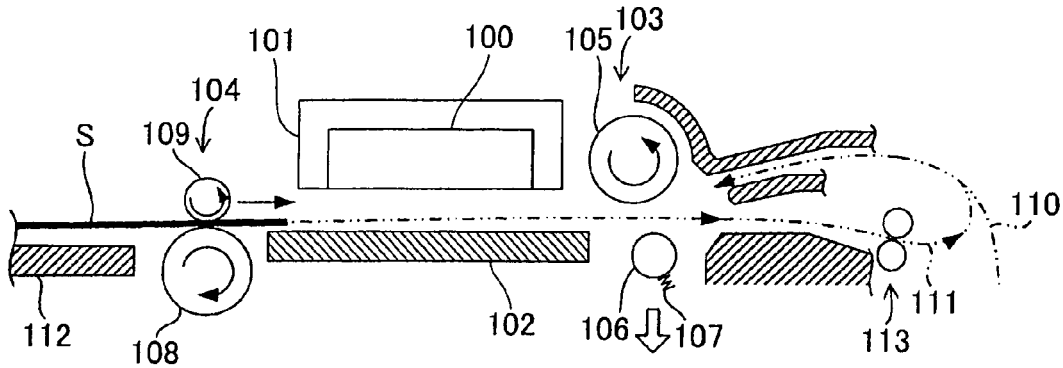
Figure 17B:
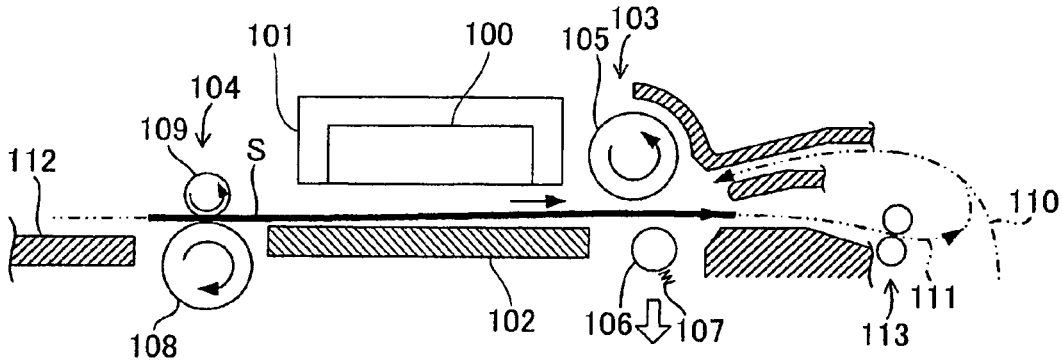
Figure 17C:
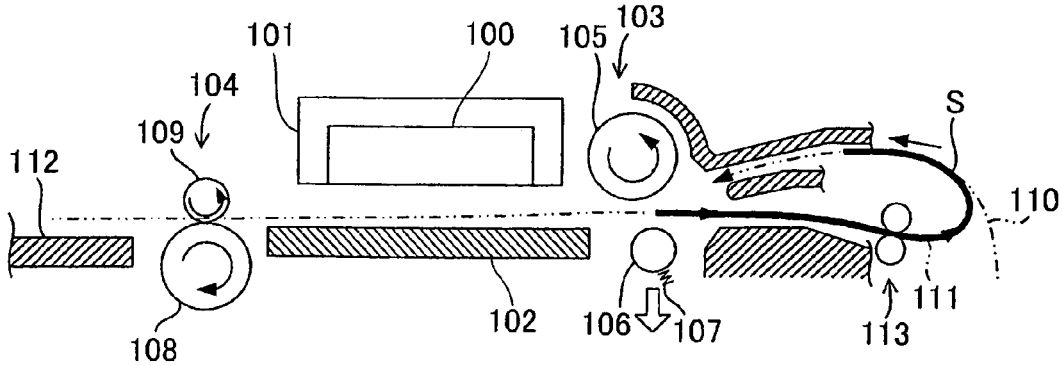
Figure 18A:
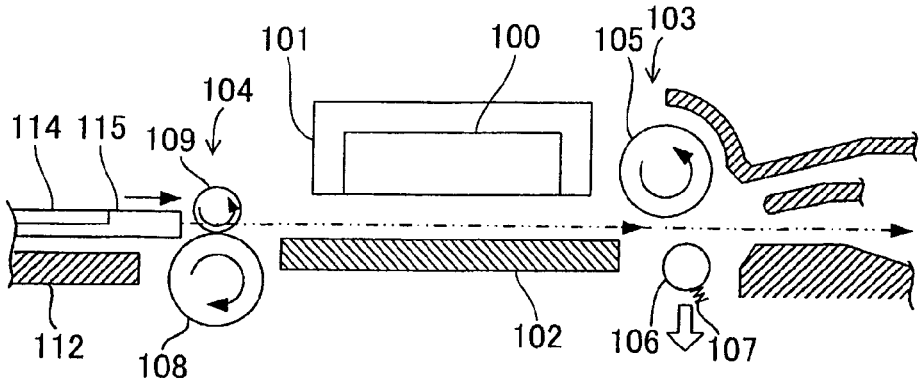
Figure 18B:
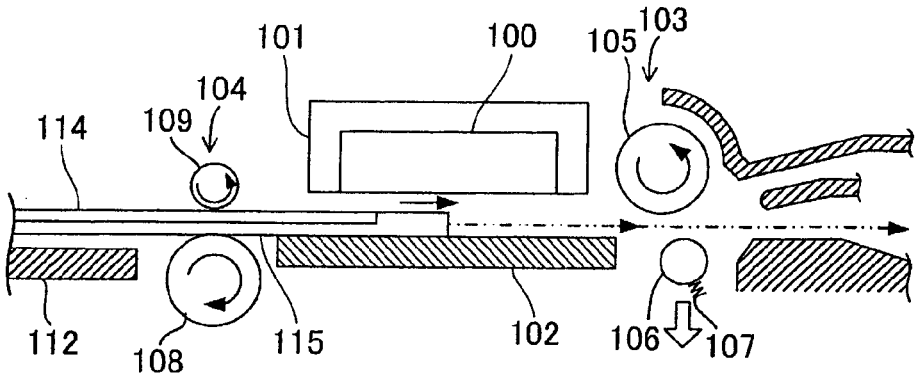
Figure 18C:
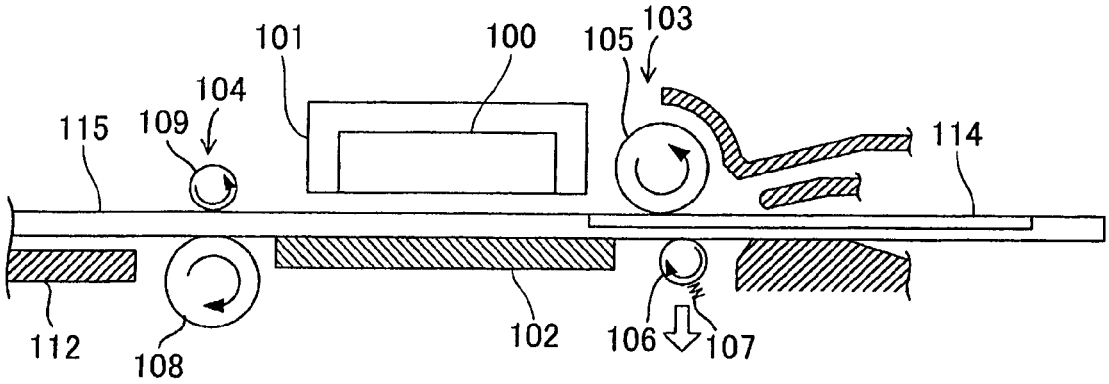
Figure 19:
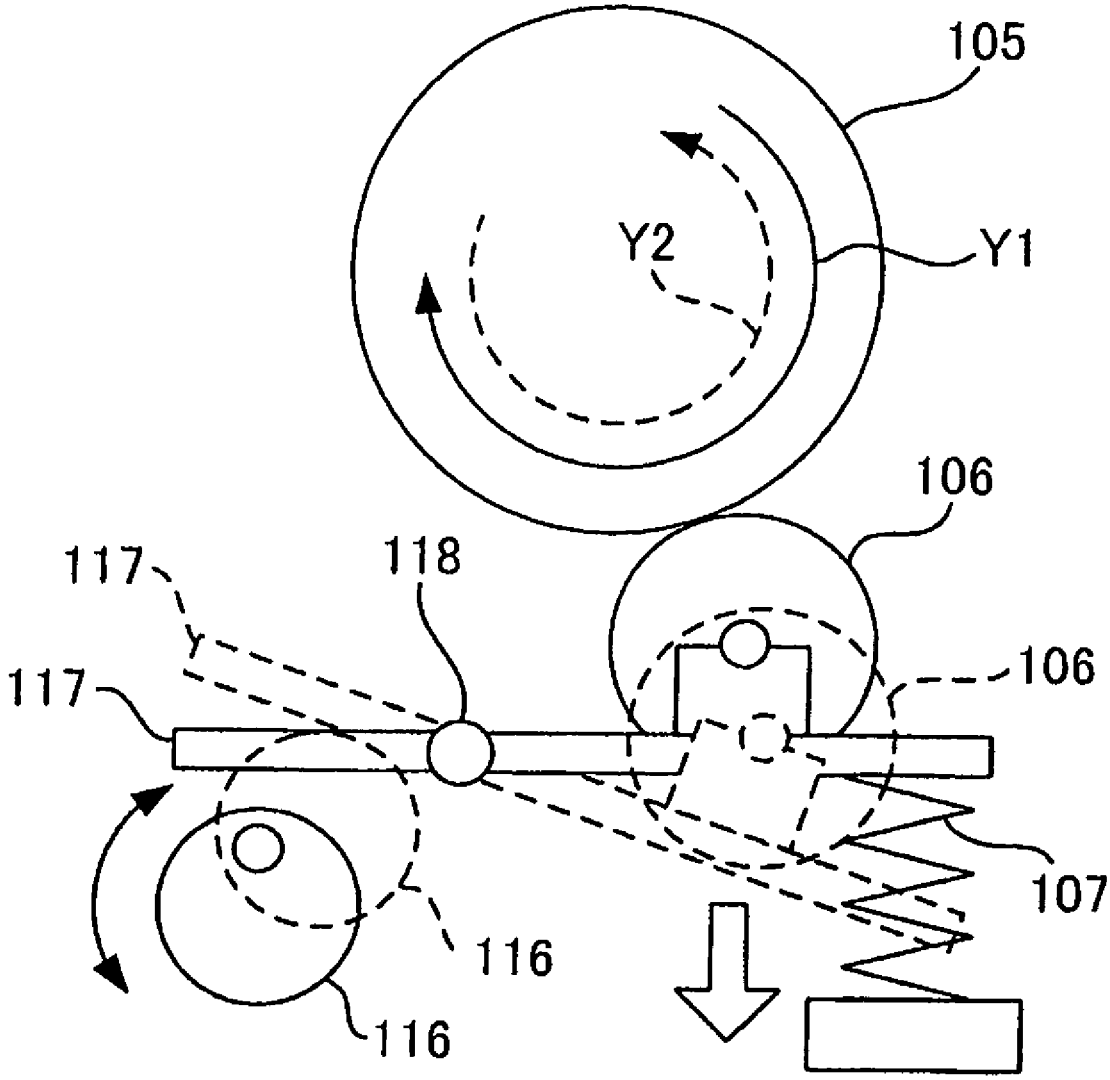

F*igs*. 16A through 16C are explanatory diagrams illustrating an image recording apparatus according to a comparative example for conveying a recording paper when performing single-sided printing;

FIGS. 17A through 17*c* are explanatory diagrams illustrating the image recording apparatus according to the comparative example for conveying a recording paper when performing duplex printing;

FIGS. 18A through 18C are explanatory diagrams illustrating an image recording apparatus according to another comparative example for conveying a media tray; and FIG. 19 is an explanatory diagram illustrating a mechanism for lowering a follow roller in the image recording apparatus according to the comparative example.

DETAILED DESCRIPTION

<First Aspect>

An image recording apparatus according to a first aspect of the invention will be described while referring to FIGS. 1 through 13C.

In the following description, the expressions "front", "rear", "upper", "lower", "right", and "left" are used to define the various parts when the image recording apparatus is disposed in an orientation in which it is intended to be used.

Figure 1:
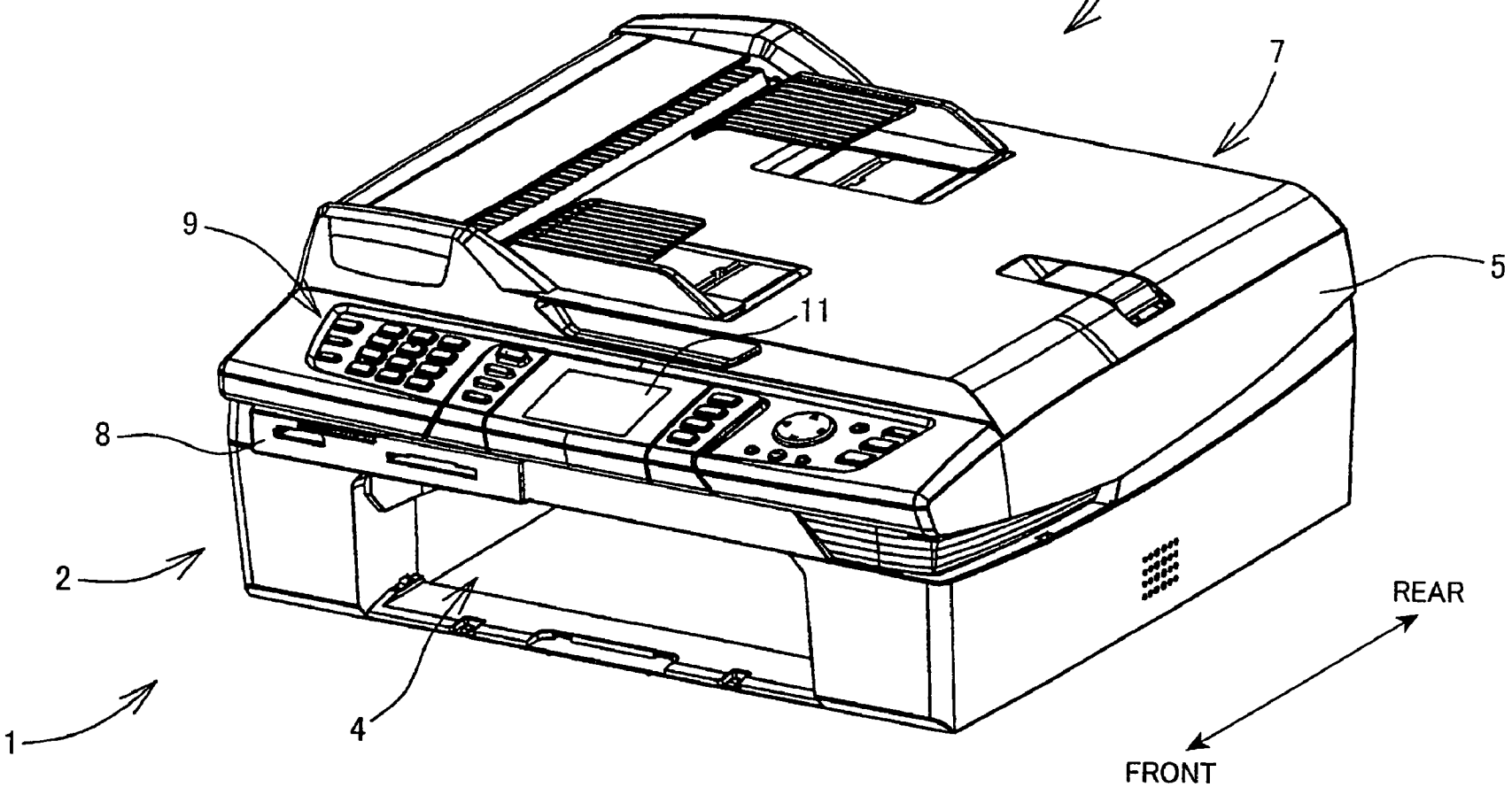
FIG. 1 is a perspective view showing the outer appearance of a multifunction device according to a first aspect of the invention.

FIG. 1 is a perspective view showing the outer appearance of a multifunction device 1, serving as the image recording apparatus according to the first aspect. As shown in FIG. 1, the multifunction device 1 is integrally configured of a printing unit 2 disposed in the bottom of the multifunction device 1, a scanning unit 3 disposed in the top of the multifunction device 1, an original cover 7 provided on top of the scanning unit 3, a control panel 9 disposed on the front side and top surface of the multifunction device 1, and a slot section 8 disposed on the front surface of the multifunction device 1. The multifunction device 1 has a printer function, scanner function, copier function, facsimile function, and the like. However, the invention can be realized with any arbitrary combination of functions, such as a scanner function and facsimile function. Hence, the invention may be applied to a standalone printer having only a printer function.

The multifunction device 1 is primarily connected to a computer (not shown) and records images and text on recording paper in the printing unit 2 based on print data including image data and text data that is transferred from the computer. Further, by connecting a digital camera or other external device to the multifunction device 1, the multifunction device 1 can record image data outputted from the external device on recording paper. Similarly, by inserting a memory card or other storage medium in the multifunction device 1, the multifunction device 1 can record image data or the like stored in the storage medium onto recording paper. The multifunction device 1 has a single-sided printing function for recording images and text on only one side of the paper based on the print data, and a duplex printing function for recording both sides of the paper. The structure of the multifunction device 1 in the following description is merely one example of an image recording apparatus according to the invention, and it should be apparent that the structure can be appropriately modified within the scope of the invention.

The control panel 9 is provided on the top front surface of the scanning unit 3, which is also the top surface on the front side of the multifunction device 1, for enabling the user to operate the printing unit 2 and scanning unit 3. The control panel 9 is configured of various operating buttons, and a liquid crystal display unit 11. Hence, the user can operate the multifunction device 1 by inputting instructions via the control panel 9. The operating buttons may be configured of a Start button for initiating operations on the printing unit 2 and scanning unit 3; a Stop button for halting operations or canceling settings; a Mode Selection button for selecting the facsimile function, numerical buttons for inputting the number of copies, the scanning resolution of the scanning unit 3, and the like; a Setting button for setting either single-sided printing (one-sided copying) or duplex printing (double-sided copying); and other input keys. A controller operates the multifunction device 1 based on input from the control panel 9. Of course, when the multifunction device 1 is connected to a computer, as described above, the multifunction device 1may be operated based on commands received from the computer via a printer driver or a scanner driver.

The slot section 8 is provided on the front surface of the multifunction device 1 near the left side thereof. Various small memory cards can be inserted into the slot section B. The multifunction device 1 reads image data stored on the memory cards inserted into the slot section 8 and displays data related to this image data on the liquid crystal display unit 11, enabling the user to print desired images on recording paper using the scanning unit 3. The user inputs a selection via the control panel 9.

As shown in FIG. 1, the scanning unit 3 includes an original scanning base 5 functioning as a flatbed scanner. The original cover 7 is attached to the original scanning base 5 via hinges (not shown) provided on the rear side surface so as to be capable of opening and closing via the hinges. The original scanning base 5 has a structure that is well known in the art, such as a structure having a contact glass disposed on the top surface, and an image-scanning unit disposed below the contact glass and housing a contact image sensor (CIS). The original cover 7 also includes an automatic document feeder (ADF) 6, When functioning as a flatbed scanner, the scanning unit 3 reads images from an original document placed on the contact glass by exposing and scanning the document as the image-scanning unit is moved under the contact glass. When reading an original image using the ADF 6, the original conveyed by the ADF 6 passes over a scanning surface of the contact glass while the image-scanning unit fixed in a position below the scanning surface reads images from the original. It should also be apparent that the invention may be applied to an image-scanning unit configured of an image sensor, such as a charge-coupled device (CCD) or a complementary metal oxide semiconductor (CMOS). Since the structure of the scanning unit 3 in the invention is arbitrary, a detailed description of the image-scanning unit will not be included in the present aspect.

Figure 2:
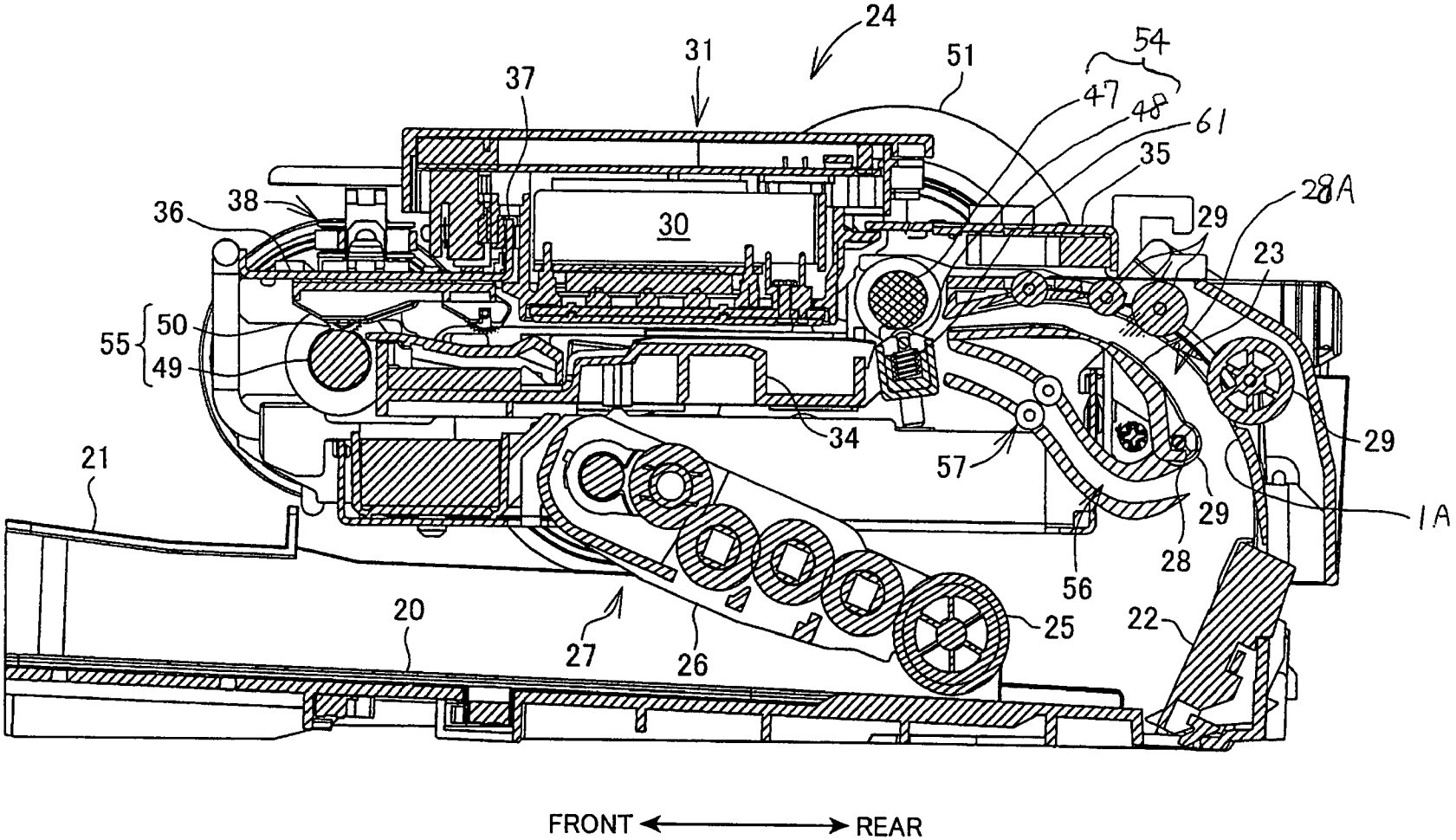
FIG. 2 is a side cross-sectional view of a printing unit provided in the multifunction device of FIG. 1.
Figure 3:
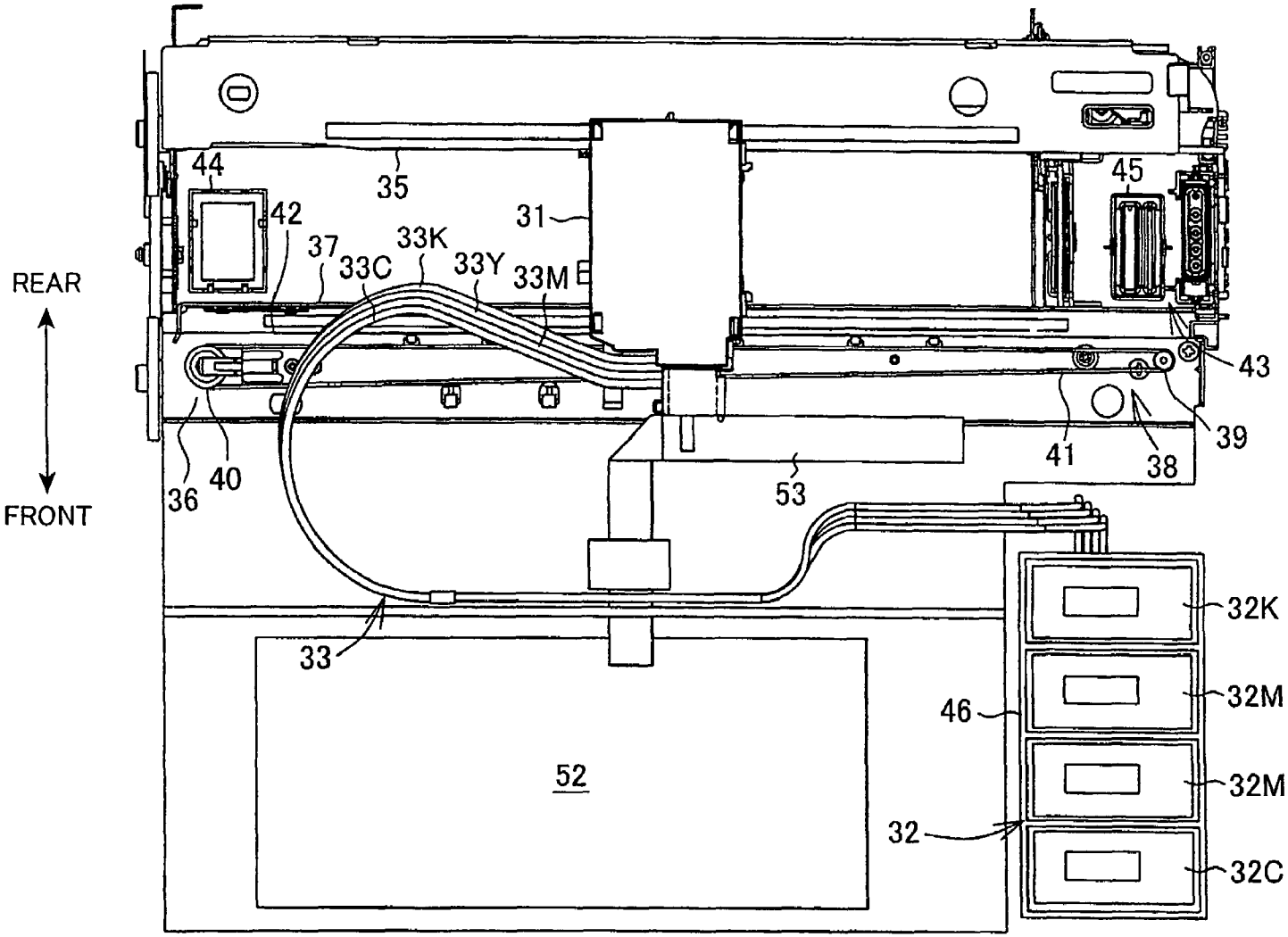
FIG. 3 is a plan view of the printing unit when a scanning unit has been removed.
Figure 4:
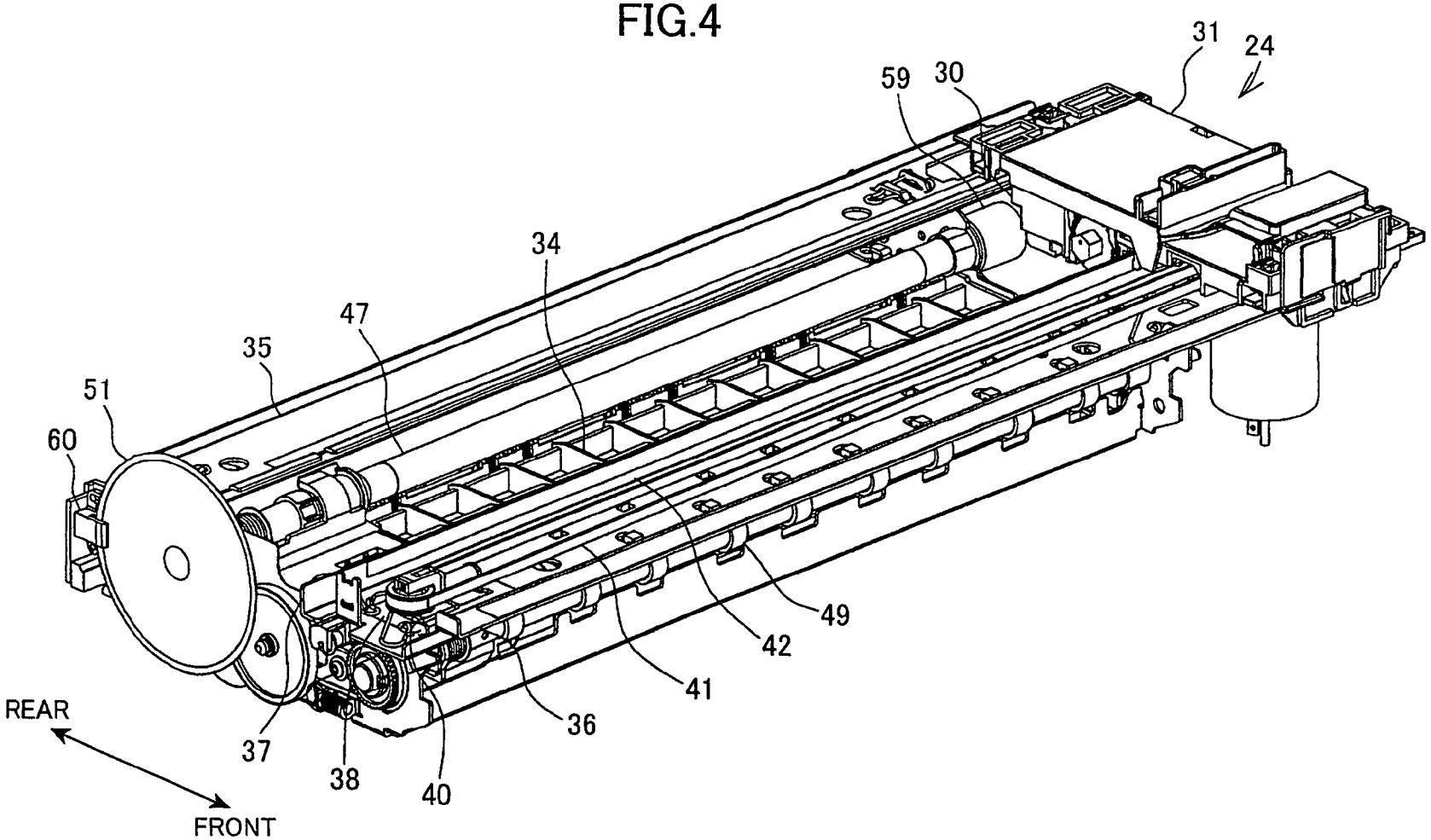
FIG. 4 is a perspective view illustrating the structure around an image recording unit.
Figure 5:
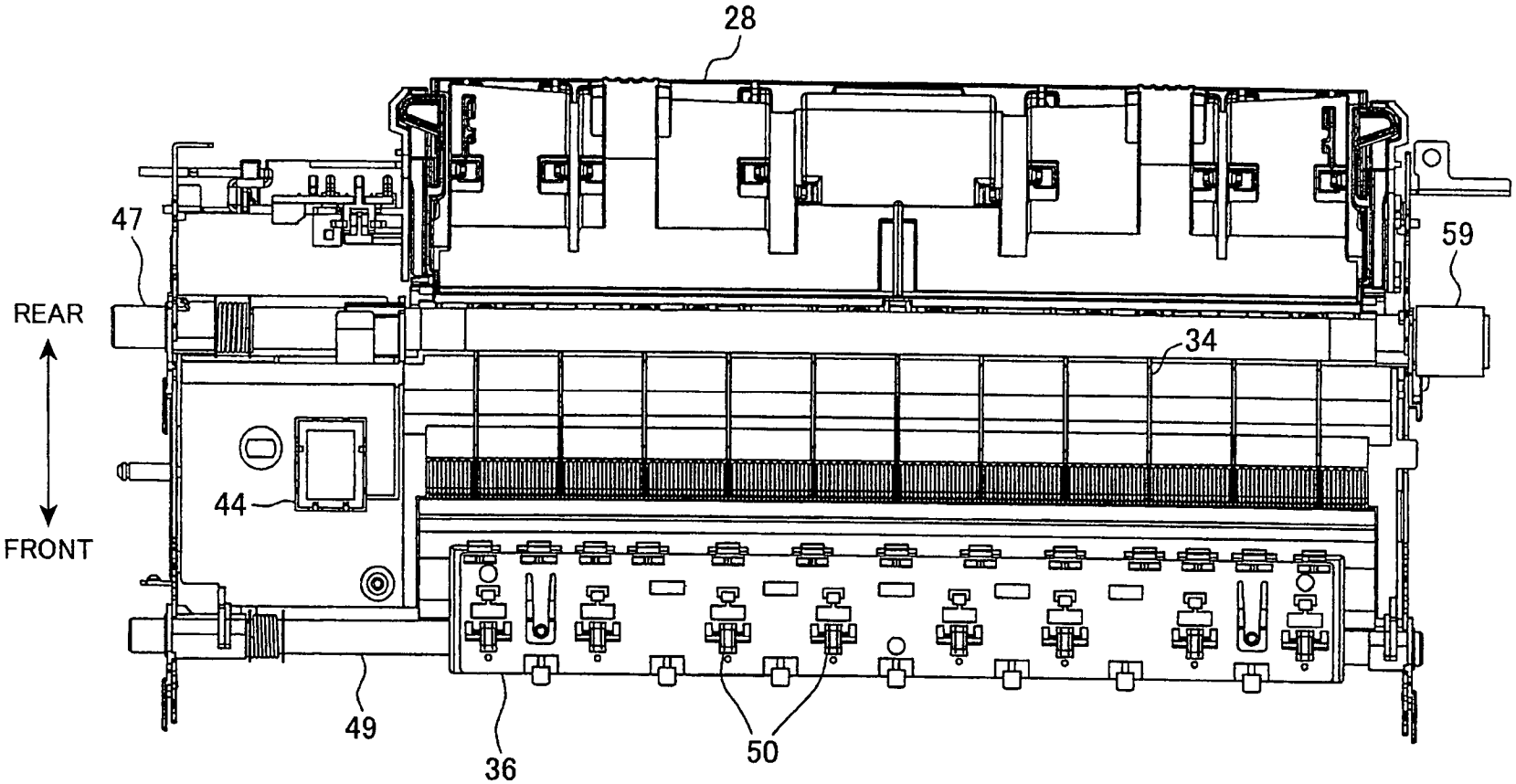
FIG. 5 is a plan view illustrating the structure around the image recording unit.

Next, the structure of the printing unit 2 will be described in detail with reference to FIGS. 1 through 5, FIG. 2 is a side cross-sectional view of the printing unit 2 provided in the multifunction device 1. FIG. 3 is a plan view of the printing unit 2 when the scanning unit 3 has been re moved. FIG. 4 is a perspective view illustrating the structure around an image recording unit described later. FIG. 5 is a plan view illustrating the structure around the image recording unit. For convenience, a recording head, belt driving mechanism, guide rail, and purging mechanism described later have been omitted from FIG. 5. The printing unit 2 described below can perform both single-sided printing and double-sided (duplex) printing.

As shown in FIGS. 1 and 2, an opening 4 is formed in the front surface side of the printing unit 2. A paper tray 20 and a discharge tray 21 are mounted in the multifunction device 1 via the opening 4. The paper tray 20 and discharge tray 21 have been omitted from FIG. 1. The paper tray 20 can accommodate a recording paper of a desired size, such as the A4 size or the B5 size. As shown in FIG. 2, the longitudinal direction of paper accommodated in the paper tray 20 extends in the depth direction (the front-to-rear direction) of the multifunction device 1 when the paper tray 20 is mounted in the multifunction device 1. The discharge tray 21 is supported on the paper tray 20 and disposed thereabove. Hence, the paper tray 20 and discharge tray 21 are stacked in two vertical levels when mounted in the multifunction device 1.

A separating sloped surface 22 is provided on the far side (rear side) of the paper tray 20 when the paper tray 20 is mounted in the multifunction device 1. The separating sloped surface 22 functions to separate paper fed from the paper tray 20 and to guide the paper upward.

A conveying path 23 is formed above the separating sloped surface 22. The conveying path 23 extends upward from the top side of the separating sloped surface 22 and curves toward the front surface side of the multifunction device 1. The conveying path 23 extends from the rear side of the multifunction device 1 to the front side, passing through the nip part of a conveying device 54 and below an image recording unit 24 described later and leads to the discharge tray 21. Hence, paper fed from the paper tray 20 is guided to the image recording unit 24 along a U-shaped path from the bottom to the top of the conveying path 23. After the image recording unit 24 records an image on the paper, the paper is discharged onto the discharge tray 21.

A reverse conveying path 56 is formed on the inside of the conveying path 23. The reverse conveying path 56 functions to invert the recording paper so that the underside surface is facing upward, by guiding paper conveyed in reverse for duplex printing to the conveying path 23. The reverse conveying path 56 begins from the upstream side of the conveying device 54, extends to near the inlet of the conveying path 23 above the separating sloped surface 22, and merges with the conveying path 23 near the inlet. The intersection of the reverse conveying path 56 and conveying path 23 has a shape that is capable of smoothly guiding paper from the reverse conveying path 56 into the conveying path 23. A pair of conveying rollers 57 is provided on the reverse conveying path 56 to convey recording paper that enters the reverse conveying path 56 from the conveying device 54 side. The conveying rollers 57 include a drive roller driven by a motor or the like, and a pinch roller that presses against and follows the rotations of the drive roller.

A feeding roller 25 is disposed above the paper tray 20. The feeding roller 25 is supported on the rear end of a feed arm 26. The feed arm 26 is capable of moving up and down so that the feeding roller 25 can contact or separate from the paper tray 20. A drive transmission mechanism 27 configured of a plurality of engaged gears transmits a driving force from a motor (not shown) to rotate the feeding roller 25. The feeding roller 25 functions to separate and feed paper stacked on the paper tray 20 to the conveying path 23 one sheet at a time. More specifically, the feeding roller 25 contacts the topmost sheet of recording paper stacked on the paper tray 20 with pressure. By rotating, the feeding roller 25 generates a frictional force between the roller surface of the feeding roller 25 and the recording paper that conveys the topmost sheet of paper to the separating sloped surface 22. The leading edge of the paper fed by the feeding roller 25 contacts the separating sloped surface 22 and is guided upward into the conveying path 23. If a sheet of paper below the topmost sheet is conveyed together with the topmost sheet due to frictional force or static electricity acting between the sheets, the sheet beneath the topmost sheet is halted when contacting the separating sloped surface 22 so that only the topmost sheet is conveyed.

Except for the region occupied by the image recording unit 24 and the like, the conveying path 23 and the reverse conveying path 56 are configured of an outer guide surface and an inner guide surface that confront each other over a predetermined distance. For example, the section of the conveying path 23 formed on the rear side of the multifunction device 1 has an outer guide surface 1A formed integrally with the frame of the multifunction device 1, and an inner guide surface 28A configured of a guide member 28 fixed to the inside of the frame. Conveying rollers 29 are provided at predetermined locations along the conveying path 23 and particularly along the curved region of the conveying path 23. The conveying rollers 29 are disposed so that the surfaces thereof are exposed from the outer guide surface 1A or inner guide surface 28A, and are capable of rotating about axes parallel to the width direction of the conveying path 23. The conveying rollers 29 enable the recording paper to be smoothly conveyed when contacting the guide surfaces 1A and 28A in the curved region of the conveying path 23.

The image recording unit 24 includes a carriage 31 that reciprocates in a main scanning direction (a direction orthogonal to the surface of the drawing in FIG. 2). A recording head 30 is mounted in the carriage 31. Ink in the colors cyan (C),magenta (M), yellow (Y), and black (Bk) is supplied to the recording head 30 from ink tanks 32 via ink tubes 33 (see FIG. 3). The recording head 30 ejects ink of each color as microdroplets through nozzles formed in the bottom surface thereof. The recording head 30 records images on a recording paper conveyed over a platen 34 as the carriage 31 reciprocates in the main scanning direction to scan the recording head 30 over the recording paper.

As shown in FIGS. 3 and 4, a pair of guide rails 35 and 36 is provided on the image recording unit 24 above the conveying path 23. The guide rails 35 and 36 extend in the width direction of the conveying path 23 and are separated from each other in the conveying direction of the recording paper. The carriage 31 is disposed so as to straddle the guide rails 35 and 36 and is capable of sliding over the guide rails 35 and 36 in the width direction of the conveying path 23. The guide rail 35 is disposed on the upstream side in the paper-conveying direction (the rear side) and has a plate shape that is longer in the width direction of the conveying path 23 than the scanning range of the carriage 31. The top surface of the guide rail 35 slidably supports the upstream end of the carriage 31, The guide rail 36 disposed on the downstream side in the paper-conveying direction (the front side) is plate-shaped and has a length in the width direction of the conveying path 23 that is substantially the same as the guide rail 35. The top surface of the guide rail 36 is bent at substantially a right angle to form an end part 37 angled upward on the upstream side of the guide rail 36 in the paper-conveying direction, An engaging member (not shown) is provided on the carriage 31 for engaging with the end part 37 of the guide rail 36 by gripping both sides of the end part 37. In this way, the carriage 31 is slidably supported on the guide rails 35 and 36 and is capable of reciprocating in the width direction of the conveying path 23 along the end part 37 of the guide rail 36. A pair of rollers or the like may also be used in place of the engaging member for gripping the end part 37. Further, sliding members may also be provided on portions of the surfaces of the guide rails 35 and 36 contacted by the carriage 31 to reduce friction, A belt-driving mechanism 38 is provided on the top surface of the guide rail 36. The belt-driving mechanism 38 includes a drive pulley 39 and a follow pulley 40 disposed near both widthwise ends of the conveying path 23, and an endless timing belt 41 disposed around the drive pulley 39 and follow pulley 40. The timing belt 41 has teeth formed on the inner side surface thereof. A motor (not shown) is coupled to the shaft of the drive pulley 39 for inputting a driving force into the shaft of the drive pulley 39. When the drive pulley 39 rotates, the timing belt 41moves in a circuitous motion. The timing belt 41 may also be configured of a belt having ends, both of which ends are fixed to the carriage 31.

The carriage 31 is fixed to the timing belt 41. By moving the timing belt 41 circuitously, the carriage 31 reciprocates over the guide rails 35 and 36 in a position based on the end part 37. Since the recording head 30 is mounted in the carriage 31, the recording head 30 also reciprocates together with the carriage 31 along the width direction of the conveying path 23, which is the main scanning direction. An encoder strip 42 of a linear encoder is provided on the guide rail 36 along the end part 37. The linear encoder detects the encoder strip 42 with a photointerrupter, and a controller (not shown) controls the reciprocating motion of the carriage 31 based on detection signals from the linear encoder.

As shown in FIGS. 2, 4, and 5, the platen 34 is disposed on the bottom of the conveying path 23 in confrontation with the recording head 30. The platen 34 extends over the center region within the reciprocating range of the carriage 31 through which the recording paper passes, The width of the platen 34 is sufficiently larger than the maximum width of recording paper that can be conveyed in the multifunction device 1 so that both edges of the paper pass over the platen 34.

As shown in FIG. 3, a purging mechanism 43 and a waste ink tray 44 are disposed outside the image recording range of the recording head 30 and,more specifically, in regions on both sides of the platen 34 through which the recording paper does not pass. The purging mechanism 43 functions to draw out air bubbles and foreign matter along with ink from nozzles and the like formed in the recording head 30. The purging mechanism 43 includes a cap 45 for covering the nozzle surface of the recording head 30. A pump mechanism is connected to the cap 45. A moving mechanism is also provided for moving the cap 45 to contact or separate from the nozzle surface of the recording head 30. When an operation is performed to re move air bubbles and the like from the recording head 30, the carriage 31 is moved so that the recording head 30 is positioned above the cap 45. Subsequently, the moving mechanism moves the cap 45 upward to form a hermetic seal over the nozzles formed in the bottom surface of the recording head 30. The pump mechanism coupled to the cap 45 then draws out ink from the nozzles.

The waste ink tray 44 is disposed on the opposite side from the purging mechanism 43 in the width direction in a position outside the image-forming range of the carriage 31. The waste ink tray 44 receives ink that has been flushed out of the recording head 30 (this operation is called "flushing"). The purging mechanism 43 and waste ink tray 44 constitute a maintenance unit that can perform such maintenance as re moving air bubbles and mixed ink of different colors from the recording head 30.

As shown in FIG. 3, the ink tanks 32 are accommodated in an ink tank accommodating section 46 disposed in the front right side of the printing unit 2. The ink tanks 32 are provided separately from the carriage 31 and recording head 30 in the printing unit 2. The ink tanks 32 include four ink tanks 32C, 32M, 32Y, and 32K accommodating ink of the respective colors cyan (C),magenta (M), yellow (Y), and black (Bk). The ink tanks 32 supply ink to the carriage 31 via the ink tubes 33.

Ink from the ink tanks 32C, 32M, 32Y, and 32K accommodated in the ink tank accommodating section 46 is supplied through the ink tubes 33, which are provided independently for each color, The ink tubes 33 are tubes formed of synthetic resin and are flexible so as to be able to bend when the carriage 31 moves in a scanning motion. Openings formed at one end of the ink tubes 33 are connected to respective joints provided at ink tank accommodating positions in the ink tank accommodating section 46. The ink tube 33C corresponds to the ink tank 32C and supplies cyan ink therefrom. Similarly, the ink tubes 33M, 33Y, and 33K correspond to the ink tanks 32M, 32Y, and 32K and supply the corresponding ink colors magenta, yellow, and black therefrom.

From the ink tank accommodating section 46, the ink tubes 33 are led along the width direction of the multifunction device 1 to a position near the center thereof, at which position the ink tubes 33 are fixed to an appropriate member on the device frame or the like. The section of the ink tubes 33 from the fixed part to the carriage 31 is a U-shaped curved portion that is not fixed to the device frame or the like and that changes in shape as the carriage 31 reciprocates. Hence, as the carriage 31 moves toward one end (the left side in FIG. 3) in the reciprocating direction, the ink tubes 33move in the same direction as the carriage 31 while flexing so that a curved radius of the U-shaped curved portion grows smaller. When the carriage 31 moves to the other end (the right side in FIG. 3) in the reciprocating direction, the ink tubes 33 move in the same direction while flexing so that the curved radius of the U-shaped curved portion grows larger.

As shown in FIGS. 2, 4, and 5, the conveying device 54 is disposed on the upstream side of the image recording unit 24. The conveying device 54 is an integrated unit configured of a drive roller 47, pinch rollers 48, and springs 61. Recording paper fed from the paper tray 20 and interposed between the drive roller 47 and pinch rollers 48 is conveyed downstream over the platen 34 by driving the drive roller 47 of the conveying device 54 in a forward rotation. The structure of the conveying device 54 is described in greater detail below.

A pair of discharge rollers 55 is provided on the downstream side of the image recording unit 24 and includes a drive roller 49, and spur rollers 50 disposed above the drive roller 49. After an image has been recorded on the paper, the paper is pinched between the drive roller 49 and spur rollers 50 and conveyed in a predetermined direction. By driving the drive roller 49 in the forward direction, the recording paper is conveyed in the forward direction and is discharged onto the discharge tray 21. By driving the drive roller 49 to rotate in the reverse direction, the recording paper is conveyed in the reverse direction. The surfaces of the spur rollers 50 are formed irregularly in a spur-like configuration so as not to degrade the image recorded on- the paper. For the same reason, the pressure between the discharge rollers 55 is set smaller than that in the conveying device 54.

As shown in FIGS. 4 and 5, a motor 59 is coupled to one axial end of the drive roller 47. A driving force transmitted from the motor 59 drives the drive rollers 47 and 49 to rotate. A control circuit board 52 (see FIG. 3) described later has a drive circuit (not shown) mounted thereon for controlling the drive rollers 47 and 49. The drive circuit switches the rotational direction of the drive rollers 47 and 49 between a forward rotation and a reverse rotation by either switching the direction of the motor 59 or switching the gears used to transmit the rotational force of the motor 59 to the rotational shafts of the rollers.

By controlling the driving of the motor 59, the motor 59 drives the drive rollers 47 and 49 intermittently at predetermined linefeed widths. The drive rollers 47 and 49 rotate in synchronization. As shown in FIG. 4, a rotary encoder includes an encoder disc 51 provided on the drive roller 47, and a photointerrupter 60 for detecting the encoder disc 51. The motor 59 is controlled to drive the drive rollers 47 and 49 based on detection signals from the rotary encoder.

Hence, paper interposed between the drive roller 47 and pinch roller 48 is conveyed intermittently over the platen 34 at predetermined linefeed widths. The recording head 30 scans the paper after each linefeed to record an image beginning from the leading edge side of the paper. After an image has been recorded on the paper, the leading edge side becomes interposed between the drive roller 49 and spur rollers 50. At this time, the paper is conveyed intermittently at the predetermined linefeed widths, while the leading edge side of the paper is interposed between the drive roller 49 and spur rollers 50, and the trailing edge side is interposed between the drive roller 47 and pinch roller 48, during which time the recording head 30 continues recording an image on the paper. After the paper is conveyed farther, the trailing edge of the paper passes through and separates from the drive roller 47 and pinch roller 48. Hence, the paper is conveyed intermittently at the predetermined linefeed widths while interposed only between the drive roller 49 and spur rollers 50 as the recording head 30 continues to record an image after each linefeed.

When performing single-sided printing, the drive roller 49 is driven to rotate continuously after the recording head 30 has completed recording an image in the predetermined region of the paper. Accordingly, the paper interposed between the drive roller 49 and spur rollers 50 is discharged onto the discharge tray 21. However, when performing duplex printing, the rotational direction of the motor 59 is switched after the recording head 30 has completed recording an image in the predetermined region of the paper, thereby switching the rotational direction of the drive rollers 47 and 49 from the forward to the reverse direction.

As shown in FIG. 3, the control circuit board 52 is disposed on the front surface side of the multifunction device 1. Recording signals are transmitted from the control circuit board 52 to the recording head 30 via a flat cable 53. The flat cable 53 is an insulated ribbon cable configured of conductors for transmitting electric signals coated in a synthetic resin film, such as a polyester film. The flat cable 53 electrically connects the control circuit board 52 to a control circuit board (not shown) in the recording head 30. The flat cable. 53 extends in the reciprocating direction from the carriage 31 and is folded back to form substantially a U-shaped portion. The U-shaped portion is not fixed to any other member and changes in shape as the carriage 31 reciprocates.

Figure 6:
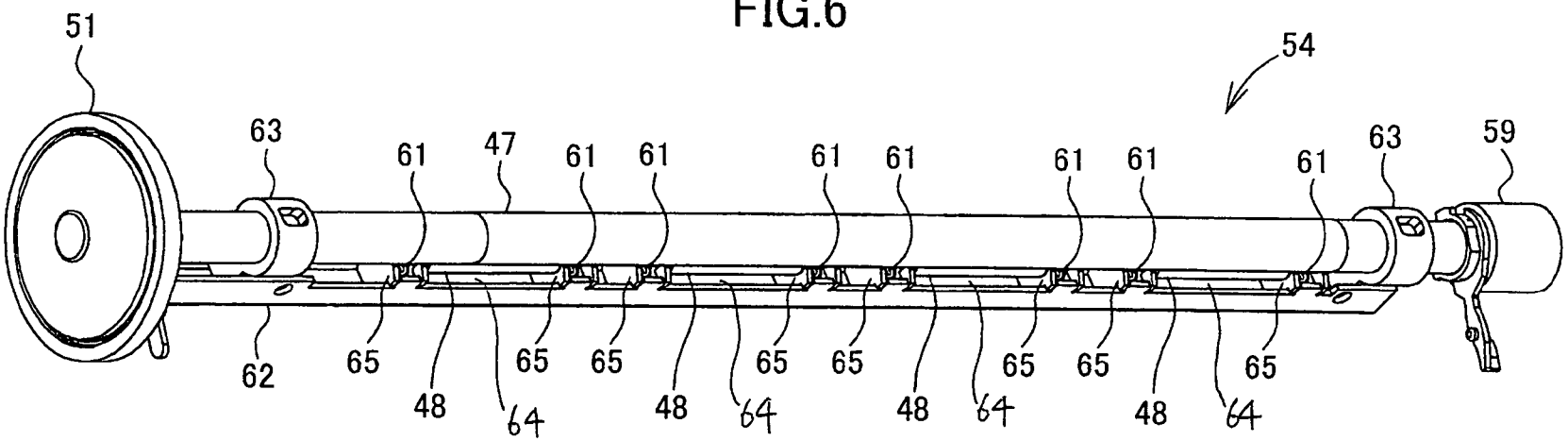
FIG. 6 is a perspective view showing the overall structure of a conveying device.
Figure 7:
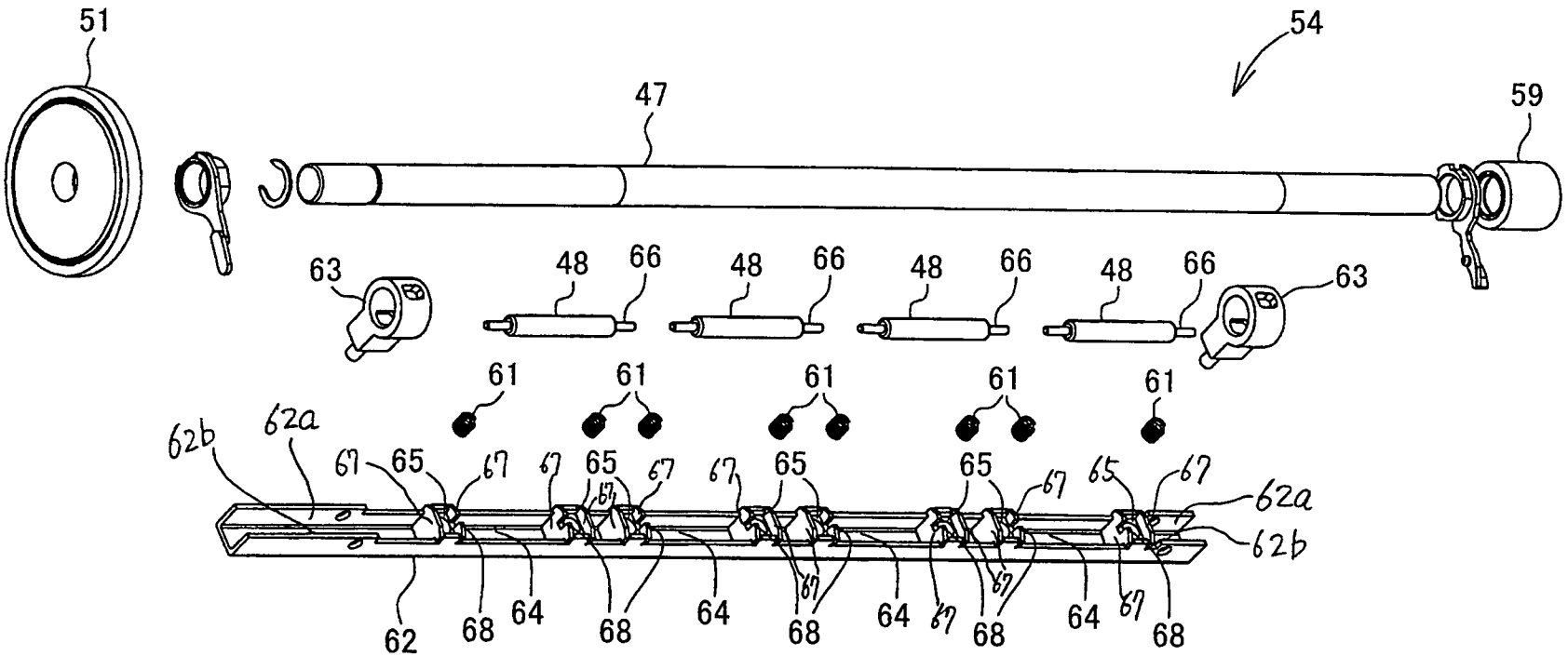
FIG. 7 is an exploded perspective view of the conveying device.
Figure 8:
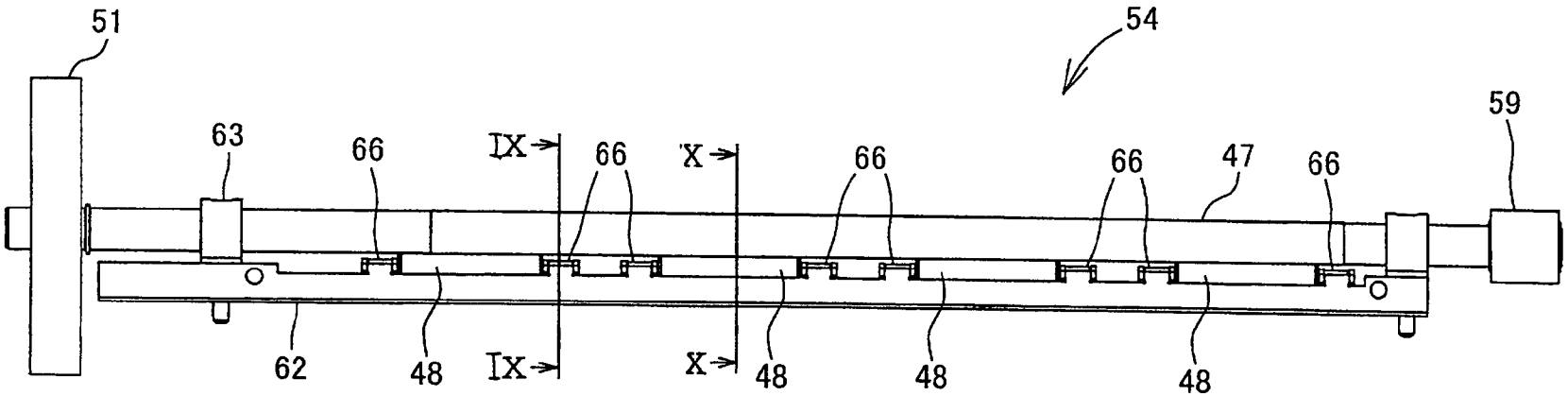
FIG. 8 is a side view of the conveying device.
Figure 9:
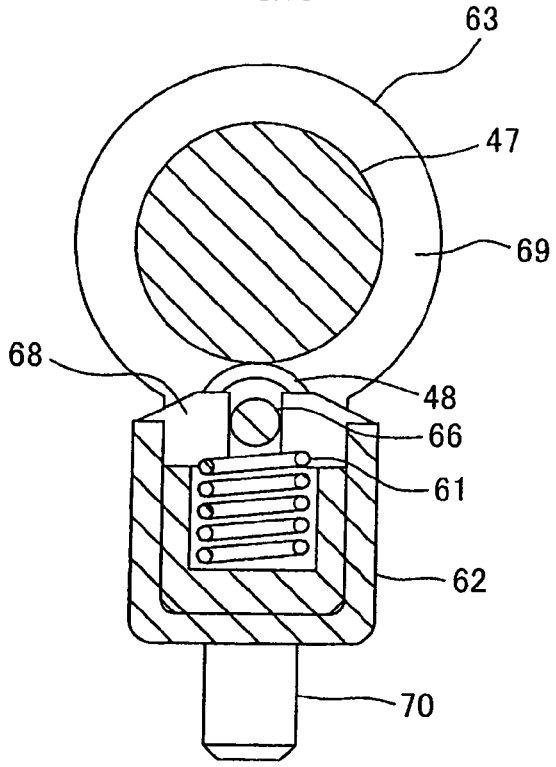
FIG. 9 is a cross-sectional view taken along a line IX-IX in FIG. 8.
Figure 10:
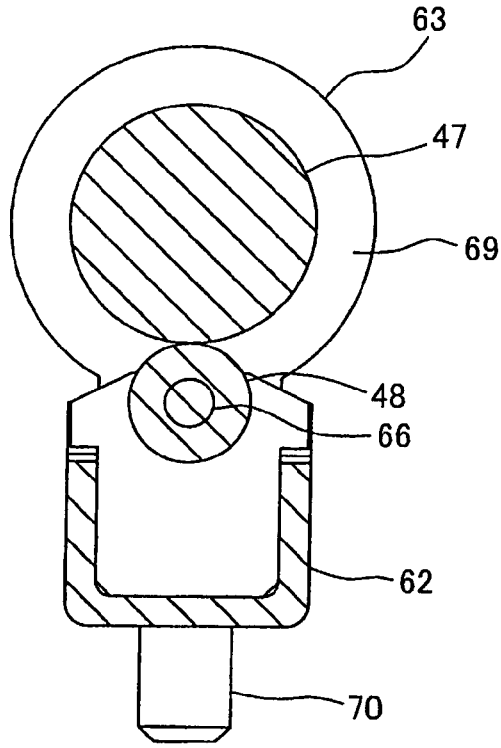
FIG. 10 is a cross-sectional view taken along a line X-X in FIG. 8.
Figure 11:
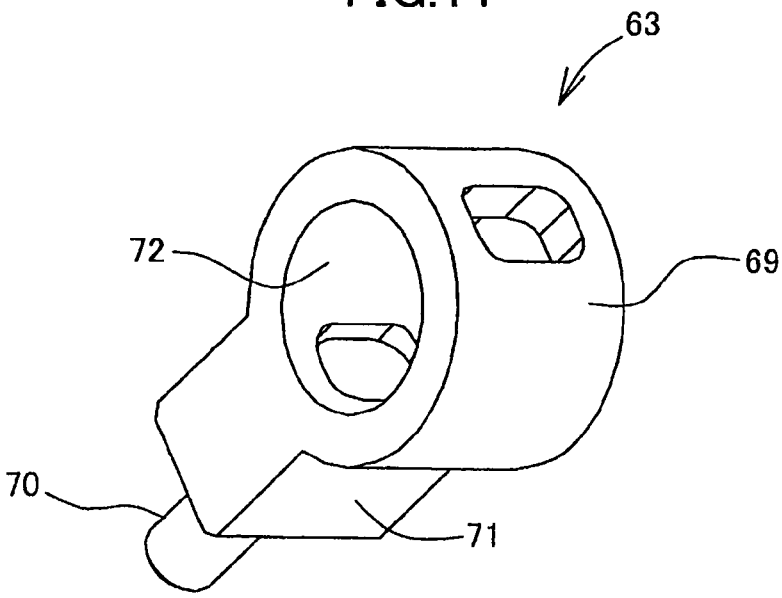
FIG. 11 is an enlarged perspective view of a support arm.

Next, the structure of the conveying device 54 will be described in detail with reference to FIGS. 6 through 11. FIG. 6 is a perspective view showing the overall structure of the conveying device 54. FIG. 7 is an exploded perspective view of the conveying device 54. FIG. 9 is a side view of the conveying device 54. FIG. 9 is a cross-sectional view taken along the line IX—IX in FIG. 8. FIG. 10 is a cross-sectional view taken along the line X—X in FIG. B. FIG. 11 is an enlarged perspective view of support arms described below.

As shown in the drawings, the conveying device 54 is an integrated unit configured broadly of the drive roller 47, the pinch rollers 48, the springs 61, a pinch roller holder 62, and support arms 63.

As shown in FIGS. 6 and 7, the pinch roller holder 62 has an elongated shape and is oriented so that the longitudinal direction matches the width direction of the recording paper. The pinch roller holder 62 has a substantially U-shaped cross section, Four roller-accommodating compartments 64, and eight spring-accommodating compartments 65 are provided on the top surface of the pinch roller holder 62 confronting the drive roller 47. The roller-accommodating compartments 64 are formed at predetermined intervals along the longitudinal direction of the pinch roller holder 62. The spring-accommodating compartments 65 are formed adjacent to and on both ends of the roller-accommodating compartments 64. The pinch rollers 48 are accommodated in the roller-accommodating compartments 64 and have rotational shafts 66 (see FIG. 7) aligned with the longitudinal direction of the pinch roller holder 62. The springs 61 are accommodated in the spring-accommodating compartments 65 in a compressed state. This structure is one example, but it should be apparent that the number of pinch rollers 48 and springs 61 and the accommodating method may be modified as appropriate, The spring-accommodating compartments 65 are defined by partitioning plates 67 erected on both longitudinal sides of the spring-accommodating compartments 65. A bearing 68 is formed in each partitioning plate 67 for supporting the rotational shaft 66 of the respective pinch roller 48. The bearings 68 are formed as long vertical grooves in the confronting partitioning plates 67 of each spring-accommodating compartments 65 so that the respective rotational shaft 66 can move vertically in the bearings 68.

The pinch roller holder 62 is coupled to the drive roller 47 by the support arms 63. As shown in FIG. 11, each support arms 63 includes a gripping part 69 that rotatably supports (grips) the shaft of the drive roller 47, an insertion part 71 that is inserted into a U-shaped groove 62*a* formed in the pinch roller holder 62, and a protruding part 70 that is fitted into an engaging hole 62*b* formed in the bottom surface of the pinch roller holder 62. A bearing (through-hole) 72 having an inner diameter substantially identical to the outer diameter of the shaft of the drive roller 47 is formed in the gripping part 69. The shaft of the drive roller 47 is rotatably inserted into the bearing 72. The support arms 63 is fixed to the pinch roller holder 62 by inserting the insertion part 71 into the pinch roller holder 62 and engaging the protruding part 70 in the engaging hole 62*b*. At this time, the support arms 63 extend from the pinch roller holder 62 toward the drive roller 47. By mounting the support arms 63 on the rotational shaft of the drive roller 47 and attaching the support arms 63 to the pinch roller holder 62, the pinch roller holder 62 is pivotally supported on the rotational shaft of the drive roller 47 via the support arms 63.

With this construction of the conveying device 54, the springs 61 are housed in the spring-accommodating compartments 65 and the rotational shafts 66 of the pinch rollers 48 are inserted into the bearings 68, compressing the springs 61. Further, as illustrated in FIGS. 9 and 10, the pinch roller holder 62 is coupled to the drive roller 47 via the support arms 63 with the pinch rollers 48 pressing against the drive roller 47. The elastic force of the compressed springs 61 urges the pinch rollers 48 toward the drive roller 47. In other words, an urging force toward the drive roller 47 is applied to the pinch rollers 48, causing the pinch rollers 48 to contact the drive roller 47 with pressure. Hence, the pinch rollers 48 are urged by the springs 61 and rotatably supported in the pinch roller holder 62. When a thick sheet of conveying paper is conveyed through the multifunction device 1, the paper pushes the pinch rollers 48 away from the drive roller 47 against the urging forces of the springs 61 by a distance corresponding to the paper thickness.

When a rotational force is not transmitted from the motor 59 to the drive roller 47 in the conveying device 54 described above, the pinch roller holder 62 hangs down from the shaft of the drive roller 47 via the support arms 63 and is held by a static frictional force generated between the gripping parts 69 and the shaft of the drive roller 47. However, when the drive roller 47 is driven to rotate, the pinch roller holder 62 pivots in a direction corresponding to this rotational direction and is pivotally moved to and is held in a predetermined position.

Figure 12A:
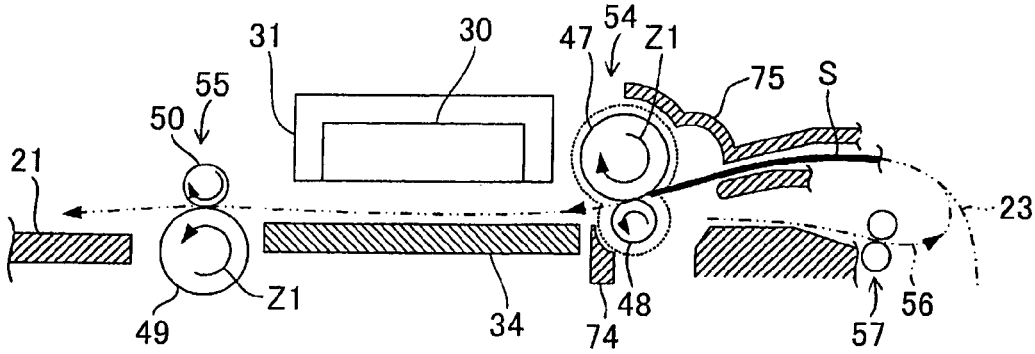
FIGS. 12A through 12C are explanatory diagrams showing the state of a pinch roller holder when a recording paper is conveyed in a forward direction.
Figure 12B:
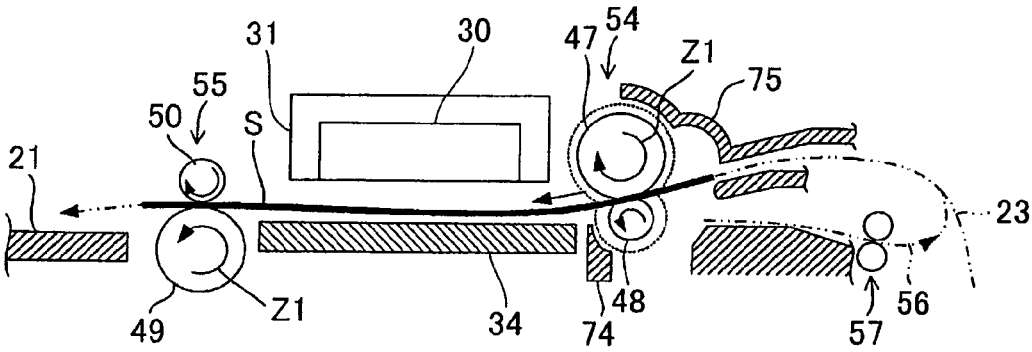
Figure 12C:
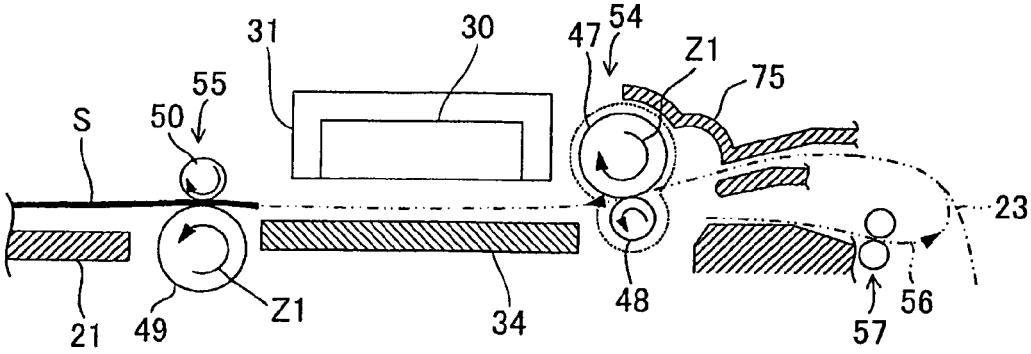
Figure 13A:
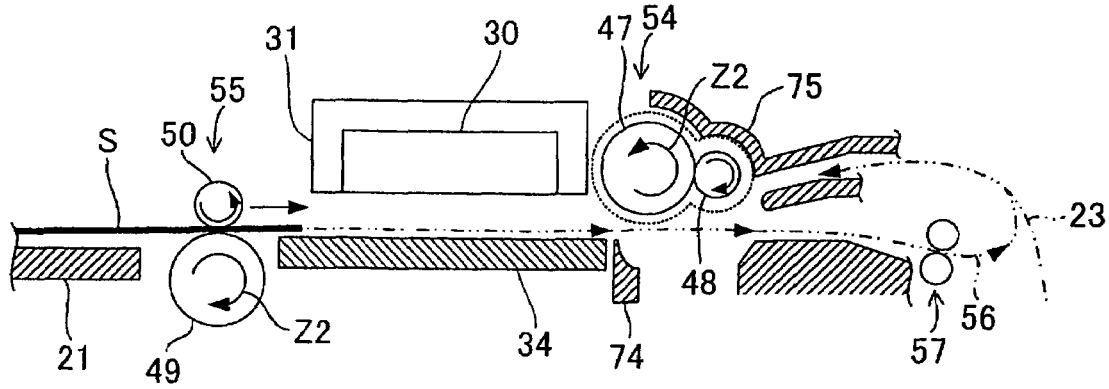
FIGS. 13A through 13C are explanatory diagrams showing the state of the pinch roller holder when the recording paper is conveyed in a reverse direction.
Figure 13B:
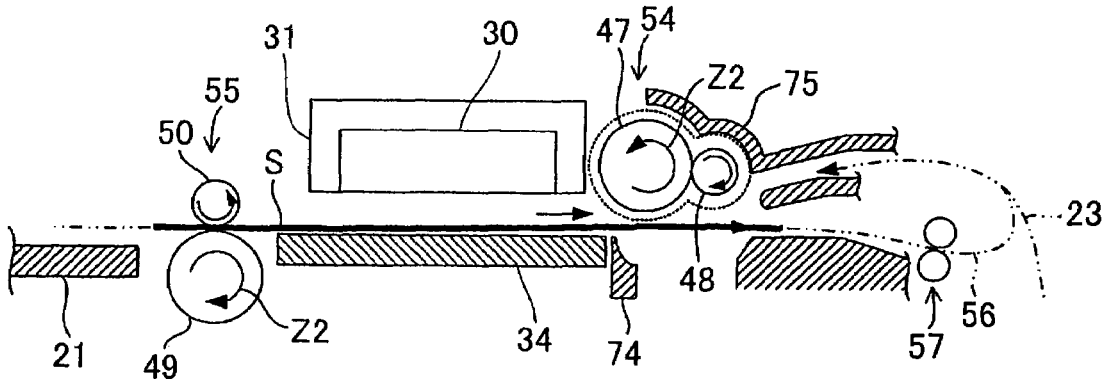
Figure 13C:
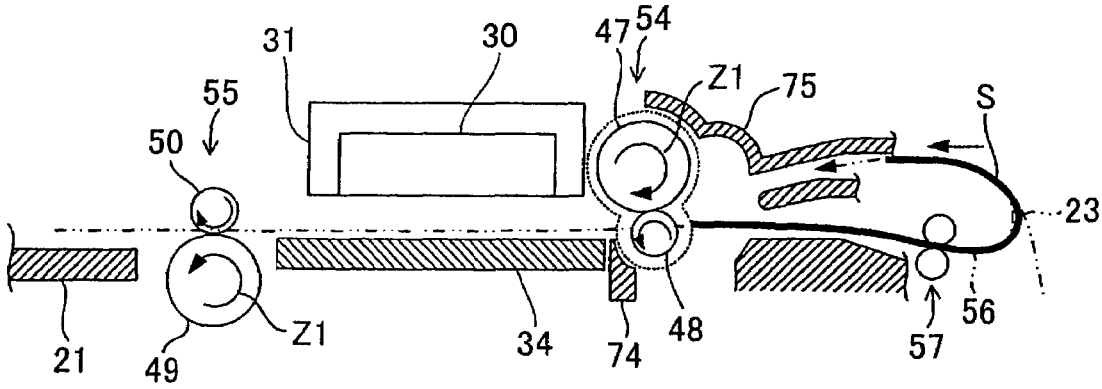

Next, the pivoting operation of the pinch roller holder 62 will be described in detail while referring to FIGS. 12A through 13C. FIGS. 12A through 12C are explanatory diagrams showing the state of the pinch roller holder 62 when a sheet of paper is conveyed in the forward direction. FIGS. 13A through 13C are explanatory diagrams showing the state of the pinch roller holder 62 when the recording paper is conveyed in the reverse direction.

In the following description, an image will be printed on both sides of the recording paper S. When a print command is inputted in the multifunction device 1, the drive rollers 47 and 49 are driven to rotate in the forward direction indicated by arrows Z1 in FIGS. 12A through 12C. Consequently, the conveying device 54 pivots in the Z1 direction (FIG. 12A) until contacting a restricting rib 74 provided on the frame of the device (not shown). The restricting rib 74 restricts further pivoting of the conveying device 54 in the Z1 direction and keeps the conveying device 54 stationary in that position. The restricting rib 74 is disposed in a position for maintaining the conveying device 54 such that a line segment connecting the axial center of the drive roller 47 and the axial center of the pinch roller 48 slopes slightly down to the right from the vertical. The conveying device 54 can convey the recording paper S when the restricting rib 74 is in this stationary position (first position). When conveyed by the conveying device 54 in this way, the recording paper S is pressed against the platen 34 and prevented from rising off the platen 34.

In the meantime, a sheet of recording paper S is fed from the discharge tray 21 and conveyed onto the conveying path 23. As shown in FIG. 12A, when the leading edge of the recording paper S conveyed along the conveying path 23 arrives at the nip part between the drive roller 47 and pinch roller 48, the drive roller 47 and pinch roller 48 pinch the leading edge of the recording paper S and begin conveying the recording paper S.

As shown in FIG. 12B, as the recording paper S is conveyed and an image is recorded on the surface of the recording paper S, the leading edge of the recording paper S eventually becomes interposed in the discharge rollers 55, at which time both the conveying device 54 and discharge rollers 55 are conveying the recording paper S. As shown in FIG. 12C, as the recording paper S is conveyed farther, the trailing edge of the recording paper S passes through the conveying device 54 so that only the discharge rollers 55 are conveying the recording paper S.

After an image has been recorded on the first surface of the recording paper S, the drive rollers 47 and 49 are temporarily halted. Subsequently, as shown in FIG. 13A, the rotating direction of the rollers is switched to a reverse direction indicated by the arrow ZZ. Consequently, as shown in FIG. 13B, the recording paper S, having an image recorded on one side, is conveyed in the reverse direction. At the same time, the conveying device 54 pivots in the 2 direction due to the reverse rotation of the drive roller 47 until contacting a restricting part 75 extending along the outer guide surface of the conveying path 23. The restricting part 75 restricts the conveying device 54 from pivoting farther in the Z2 direction and maintains the conveying device 54 stationary at this position (second position). As shown in FIGS. 13A through 13C, the restricting part 75 is disposed at a position allowing the pinch roller 48 to be retracted from the conveying path 23, Since the pinch roller holder 62 automatically pivots out of the conveying path 23 when the rotating direction of the drive roller 47 is switched for conveying the recording paper S in reverse, the recording paper S can be smoothly conveyed in reverse onto the reverse conveying path 56 without providing a separate motor or the like.

As shown in FIG. 13B, as the recording paper S is further conveyed in reverse, the leading edge in the current conveying direction passes the conveying device 54 without becoming interposed therein and is guided into the reverse conveying path 56. Hence, even if the ink ejected onto the recording paper S has not completely dried, the recording paper S can be conveyed along the reverse conveying path 56 without waiting for the ink to dry, thereby shortening the conveying time. This construction can prevent the recorded image from being affected when the recording paper S is conveyed in reverse since the recording paper S is not gripped by the conveying device 54. As shown in FIG. 13C, after the recording paper S enters the reverse conveying path 56, the conveying rollers 57 convey the recording paper S from the reverse conveying path 56 back onto the conveying path 23 so that the second surface (underside surface) of the recording paper S is facing upward. In this way, the recording paper S can be inverted and subsequently the rotating direction of the drive rollers 47 and 49 can be switched to the forward direction indicated by the arrows Z1 at a suitable timing after the trailing edge of the recording paper S passes the conveying device 54. During this time, the rotational direction of the conveying rollers 57 is unchanged. Next, the conveying device 54 grips and conveys the recording paper S, with the underside surface facing up, toward the platen 34; the recording head 30 records an image on the second surface of the recording paper S; and the discharge rollers 55 discharge the recording paper S onto the discharge tray 21.

In this way, the position of the follow roller 48 can be changed through a simple mechanism that does not require special mechanical components, such as a motor or transmitting means. The above-described configuration can also prevent the conveying device 54 from damaging the recording paper S and prevent problems in conveyance.

Further, in the above-described configuration, the pinch rollers 48 are supported at predetermined intervals along the axial direction of the drive roller 47. Since all of the pinch rollers 48 pivot simultaneously, the pinch rollers 48 can be configured to press against the drive roller 47 and pinch the leading edge of the recording paper S uniformly when conveying the recording paper S to the image recording position.

<Second Aspect>

Figure 14A:
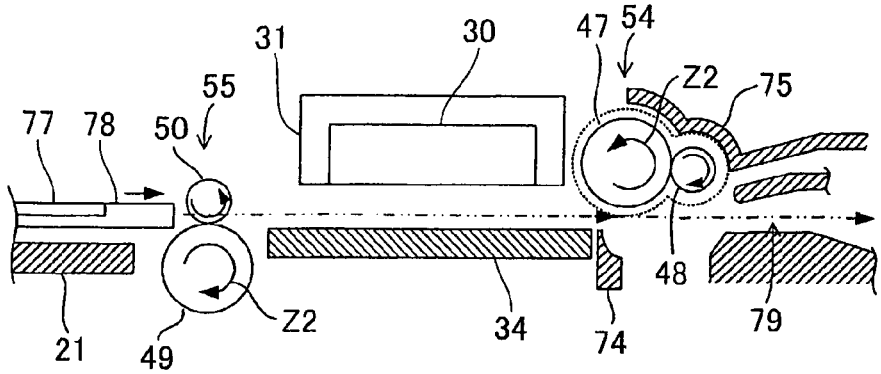
FIGS. 14A through 14C are explanatory diagrams showing a conveying device of a multifunction device according to a second aspect of the invention, and particularly showing the state of a pinch roller holder when a media tray is conveyed in the reverse direction.
Figure 14B:
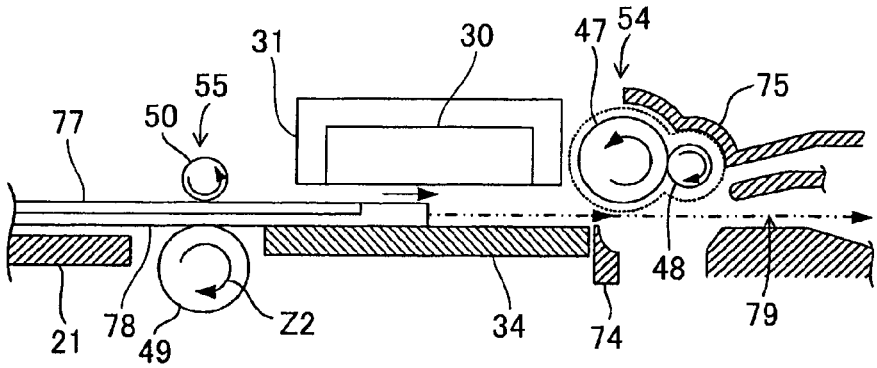
Figure 14C:
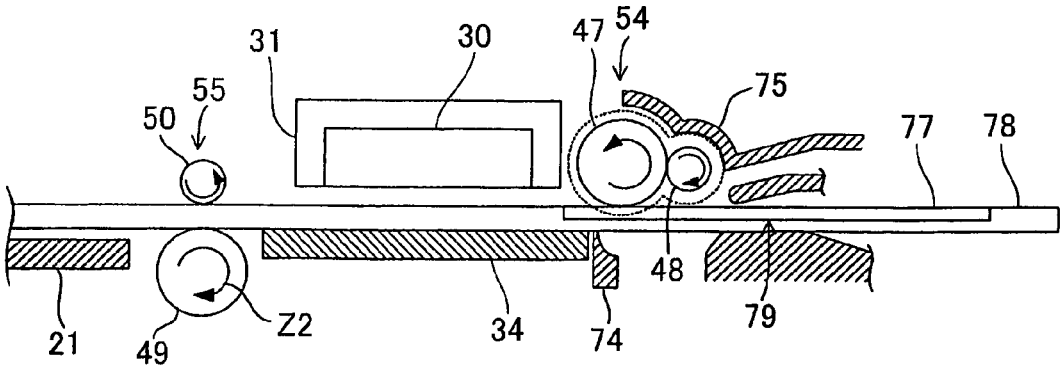

An image recording apparatus according to a second aspect of the invention will be described while referring to FIGS. 14A through 14C wherein like parts and components are designated by the same reference numerals to avoid duplicating description.

In the first aspect described above, an operation is performed in the multifunction device 1 to pivot the conveying device 54 when performing duplex printing. However, in the second aspect, the invention is applied to a multifunction device having a function for recording images on a disc surface of a recording medium 77, The recording medium 77 is mounted in a media tray 78, and the media tray 78 is inserted onto the conveying path 23 in the reverse direction via the discharge tray 21 (see FIG. 2). An image is recorded on the disc surface of the recording medium 77 as the media tray 78 is conveyed in reverse. Next, an operation to pivot the pinch roller holder 62 when the media tray 78 is conveyed in reverse will be described with reference to FIGS. 14A through 14C. FIGS. 14A through 14C are explanatory diagrams showing the state of the pinch roller holder 62 when the media tray 78 is conveyed in the reverse direction.

In the multifunction device according to the second aspect, a retracting path 79 is provided in place of the reverse conveying path 56 as an extension to the surface of the platen 34 for receiving the media tray 78. Excluding the retracting path 79, the structure of the multifunction device is identical to the multifunction device 1 in the first aspect described above. Therefore, a description of the structure of the multifunction device will not be repeated. Further, it should be apparent that the invention can be applied to a multifunction device having both the reverse conveying path 56 and the retracting path 79.

The recording medium 77 is a CD-ROM disc or a DVD-ROM disc having a disc surface that can be recorded. When recording an image on the disc surface of the recording medium 77, the recording medium 77 is loaded in the media tray 78 and the media tray 78 is inserted onto the conveying path 23 via the discharge tray 21. At this time, a sensor (not shown) detects the media tray 78, triggering the drive rollers 47 and 49 to begin driving in the reverse rotation. Specifically, as shown in FIGS. 14A through 14C, the drive rollers 47 and 49 rotate in the direction indicated by the arrows Z2. As the drive roller 47 rotates in reverse, the conveying device 54 pivots in the Z2 direction until contacting the restricting part 75, at which point the restricting part 75 restricts further pivoting of the conveying device 54. Since the conveying device 54 is retracted in this way, the media tray 78 can pass into the retracting path 79 without interference from the conveying device 54, thereby preventing damage to the recording medium 77 or the media tray 78 that can occur if the recording medium 77 and media tray 78 are pinched in the conveying device 54.

After the recording medium 77 in the media tray 78 passes over the platen 34, driving of the drive rollers 47 and 49 is temporarily halted, and subsequently the rotating direction of the rollers is switched to the forward position. Next, the media tray 78 passes over the platen 34 in the forward direction as the recording head 30 records an image on the disc surface of the recording medium 77. Finally, the recording medium 77 and media tray 78 are discharged onto the discharge tray 21. Although the drive roller 47 may also be separated from the media tray 78, the drive roller 47 should be positioned so that the forward rotational force of the drive roller 47 is transmitted to the media tray 78 in order to smoothly convey the media tray 78 in the forward direction.

<Third Aspect>

Figure 15A:
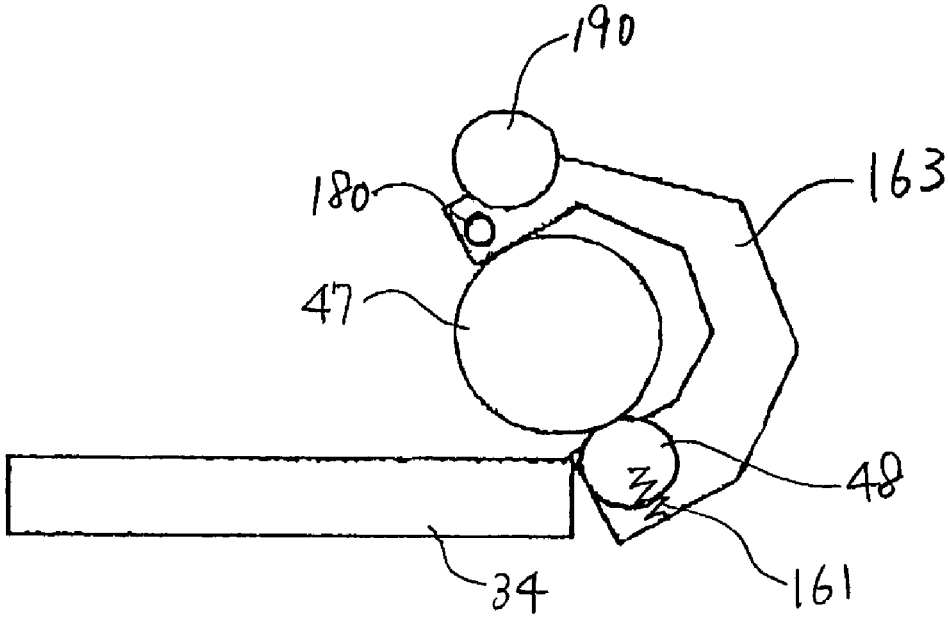
FIG. 15A is an explanatory diagram showing a support structure of a conveying device according to a third aspect of the invention, in which the pinch rollers are located on a conveying path for conveying a recording paper.
Figure 15B:
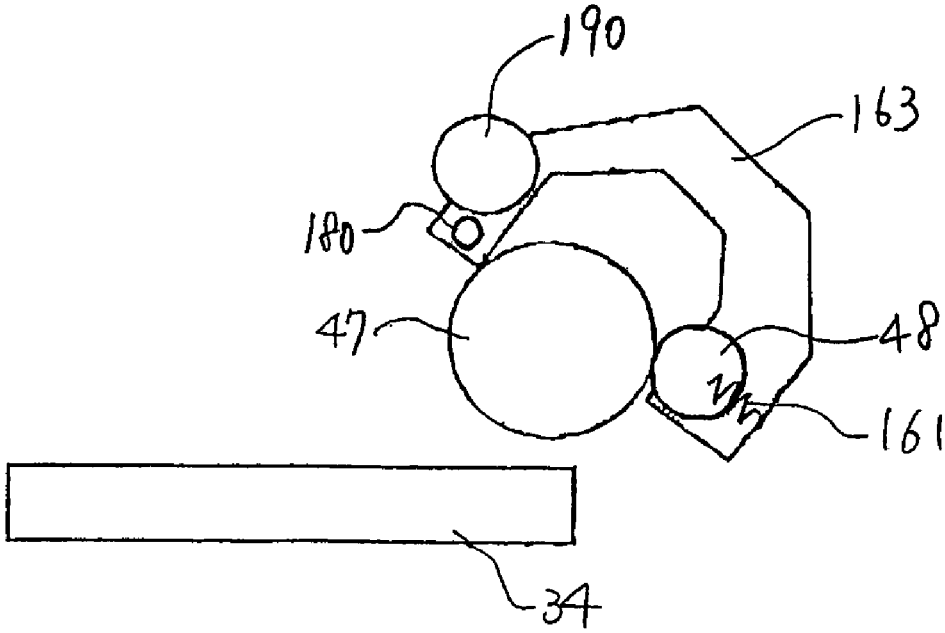
FIG. 15B is an explanatory diagram showing the support structure of the conveying device shown in FIG. 15A, in which the pinch rollers are retracted from the conveying path.

An image recording apparatus according to a third aspect of the invention will be described while referring to FIGS. 15A and 15B wherein like parts and components are designated by the same reference numerals to avoid duplicating description.

In the aspects described above, the pinch roller holder 62 is supported by the support arms 63 which are pivotally supported by the rotational shaft of the drive roller 47. However, the invention is not limited to this support structure, For example, a support structure according to the third aspect in FIGS. 15A and 15B includes support arms 163 having a substantially U-shape. One end of the support arms 163 is pivotally supported by a pivoting shaft 180 different from the rotational shaft of the drive roller 47. A pinch roller holder (not shown) is supported on another end of the support arms 163. The pinch rollers 48 are rotatably supported by the pinch roller holder. Springs 161 are disposed at the pinch roller holder for pressing the pinch rollers 48 against the drive roller 47. Hence, the pinch rollers 48 are configured to revolve around the drive roller 47. A drive source (not shown) independent from the motor 59 is coupled to a coupling part 190 of the pivoting shaft 163 and pivotally moves the support arms 163. Note that the drive source may be the motor 59 itself. By controlling the drive source, the support arms 163 can be pivoted to switch the pinch roller holder and the pinch rollers 48 between: the first position (FIG. 15A) at which the pinch rollers 48 are located on the conveying path for conveying the recording paper S; and the second position (FIG. 15B) at which the pinch rollers 48 are retracted from the conveying path. Through this simple construction, the pinch rollers 48 can be retracted from the conveying path to prevent damage to the recording paper S or the media tray 78. This construction for pivoting the support arms 163 with the drive source may also be applied to the first and second aspects described above.

While the invention has been described in detail with reference to the above aspects thereof, it would be apparent to those skilled in the art that various changes and modifications may be made therein without departing from the spirit of the invention,

<COMPARATIVE EXAMPLES>

An image recording apparatus according to comparative examples will be described while referring to FIGS. 16A through 19.

Figure 16A:
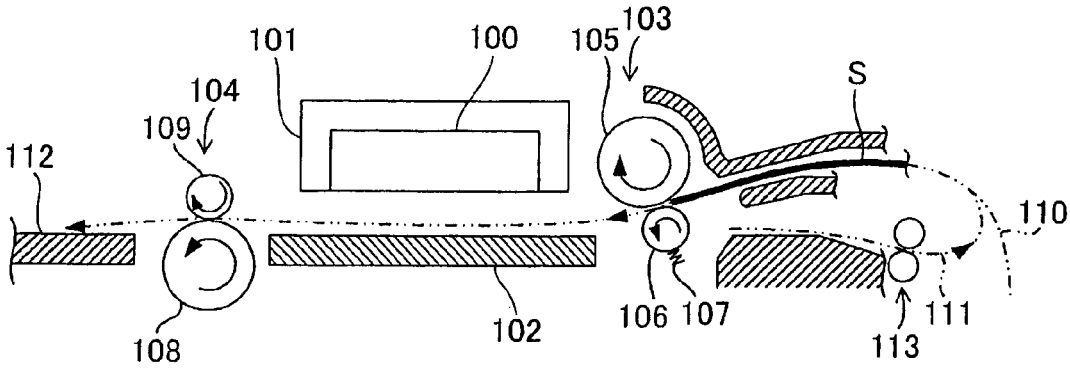
Figure 16B:
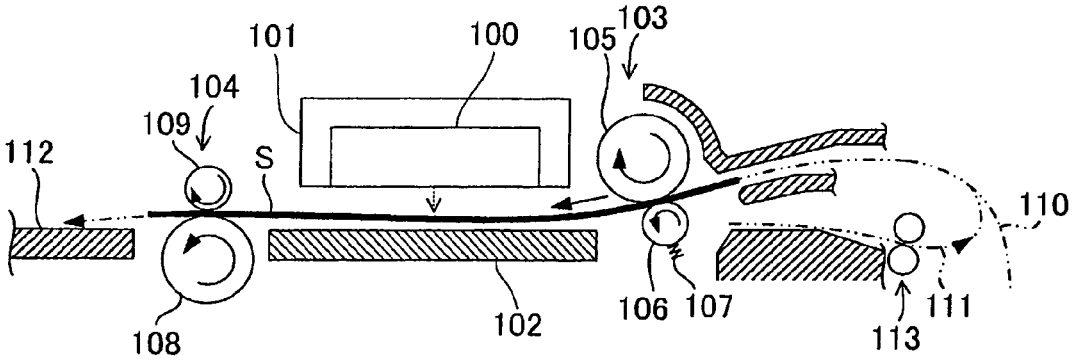
Figure 16C:
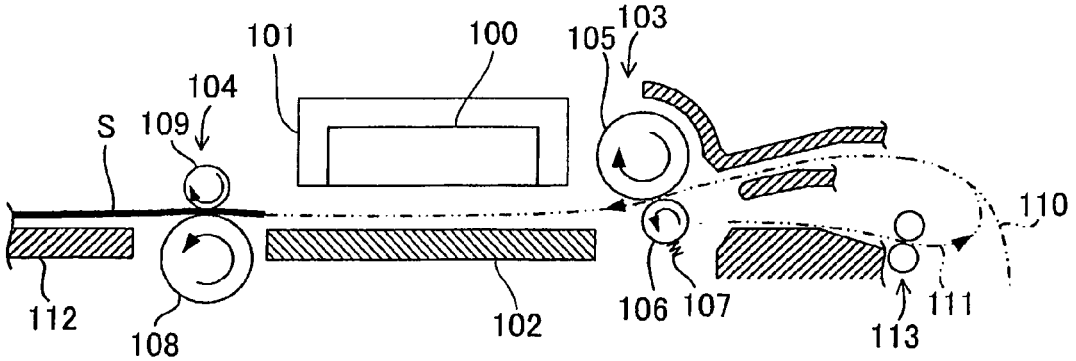

As shown in FIGS. 16A through 16C, an image recording apparatus includes a paper cassette (not shown); a paper-conveying path 110; and a pair of conveying rollers 103 and a pair of discharge rollers 104 disposed along the paper-conveying path 110 for conveying a recording paper S from the paper cassette along the paper-conveying path 110. This image recording apparatus also includes a platen 102 disposed on the paper-conveying path 110, a carriage 101 that can be moved by sliding in a direction (a direction perpendicular to the surface of the drawing of FIGS. 16A through 16C) orthogonal to a conveying direction for conveying the recording paper S (left-and-right direction in FIGS. 16A through 16C), and a recording head 100 mounted in the carriage 101 so as to confront the platen 102. In the image recording apparatus having this construction, the recording paper S is conveyed intermittently over the platen 102 by predetermined steps, while the carriage 101 conveys the recording head 100, and the recording head 100 ejects ink from nozzles therein onto the recording paper S, thereby recording an image by predetermined regions.

A controller (not shown) controls the rotations of the conveying rollers 103 disposed upstream of the platen 102 in the paper-conveying direction (hereinafter abbreviated as the "upstream side") and the discharge rollers 104 disposed downstream of the platen 102 in the paper-conveying direction (hereinafter abbreviated as the "downstream side") in order to convey the recording paper S intermittently. The conveying rollers 103 are configured of a drive roller 105 that is driven to rotate by a rotational force transmitted from a motor or the like, a follow roller 106, and coil springs 107 that urge the follow roller 106 to contact the drive roller 105 with pressure. Similarly, the discharge rollers 104 include a drive roller 108 and a follow roller 109. However, since the discharge rollers 104 pinch and convey the recording paper S after an image has been recorded thereon, the pressing force of the follow roller 109 is set less than that in the conveying rollers 103 to avoid degrading the image.

As shown in FIGS. 16A through 1GC, the drive roller 105 is disposed above the upper surface of the platen 102 and conveys the recording paper S downward so as to press the recording paper S against the platen 102 and prevent the recording paper S from floating off the platen 102. The follow roller 106 is disposed so as to press against the drive roller 105 from a position slightly rearward of a position directly below the drive roller 105. There is another type of image recording apparatus in which the positions of the follow roller 106 and drive roller 105 are reversed.

When performing single-sided printing, that is, when recording an image on a first surface of the recording paper S, the image recording apparatus described above conveys the recording paper S as follows. First, as shown in FIG. 16A, when the leading edge of the recording paper S arrives at the conveying rollers 103, the recording paper S becomes interposed between the drive roller 105, which is driven in a forward rotation, and the follow roller 106 and is conveyed forward by the conveying rollers 103. As the conveying rollers 103 convey the recording paper S farther, as shown in FIG. 16B, the discharge rollers 104 grip the leading edge of the recording paper S so that the recording paper S is now being conveyed by both the conveying rollers 103 and discharge rollers 104. As the recording paper S is 5 conveyed further, as shown in FIG. 16C, the trailing edge of the recording paper S separates from the conveying rollers 103, so that the recording paper S is conveyed only by the discharge rollers 104. Subsequently, the discharge rollers 104 discharge the recording paper S onto a discharge tray 112.

In the case of duplex printing, that is, when printing images on both surfaces of the recording paper S, as shown in FIG. 17A, driving of the discharge rollers 104 is temporarily halted after recording an image on the first surface of the recording paper S. Subsequently, the discharge rollers 104 are driven in reverse so that the recording paper S is conveyed in reverse. The follow roller 106 is also lowered when the recording paper S is conveyed in reverse. As a result, as shown in FIG. 17B, the recording paper S is not pinched between the conveying rollers 103, but rather passes through the conveying rollers 103 and is guided onto a reverse conveying path 111. As shown in FIG. 17C, a pair of reverse conveying rollers 113 is disposed along the reverse conveying path 111 for returning the recording paper S guided along the reverse conveying path 111 to the paper-conveying path 110. This process inverts the recording paper S so that the sides are reversed. Subsequently, the rotational direction of the conveying rollers 103 and discharge rollers 104 is switched to the forward rotation, and the recording paper S is conveyed to the platen 102 with a second surface (underside surface) facing upward.

Dropping the follow roller 106 when the recording paper S is conveyed in reverse so that the recording paper S is not pinched and conveyed by the conveying rollers 103 prevents various problems, such as a drop in image quality caused by the conveying rollers 103 pinching the recording paper S before the image is dry, problems in conveying the recording paper S due to the offset position of the conveying rollers 103 relative to the platen 102, and damage to the recording paper S due to such conveying problems.

Another image recording apparatus shown in F*igs*. 18A through 18C has a media tray 115 in which a storage medium 114, such as a CD-ROM disc, can be inserted and has a function for recording an image on the disc surface of the storage medium 114. In this image recording apparatus, the media tray 115 can be inserted into the image recording apparatus from the discharge tray 112 side and conveyed in the reverse direction by the conveying rollers 103 and discharge rollers 104 rotating in reverse. The follow roller 106 is also lowered in this case to prevent the conveying rollers 103 from pinching and damaging the storage medium 114 or media tray 115. As the media tray 115 is conveyed in reverse, the leading portion of the media tray 115 is retracted along a separate path (not shown).

A cam mechanism for lowering the follow roller 106 is shown in FIG. 19. As shown in FIG. 19, the cam mechanism includes an arm 117 supported at a support point 118 in the approximate center thereof, and an eccentric cam 116. As shown in FIG. 19, one end of the arm 117 is coupled to the rotational shaft of the follow roller 106, while the other end is moved up and down by a motor or the like driving the eccentric cam 116. The arm 117 moves the follow roller 106 up and down using the principle of the lever. With this cam mechanism, the eccentric cam 116 is driven by a motor (not shown) to a position minimizing the upward displacement of the eccentric cam 116 when the drive roller 105 is rotating forward, as indicated by the arrow Y1 in FIG. 19. At this 5 time, the coil springs 107 expand to a maximum amount and urge the follow roller 106 upward so that the follow roller 106 presses against the drive roller 105. When the drive roller 105 is rotating in reverser indicated by the arrow Y2 in FIG. 18, the eccentric cam 116 is driven by the motor to displace the arm 117 upward a maximum distance. At this time, the coil springs 107 is compressed by the arm 117, and the follow roller 106 is lowered and separated from the drive roller 105.

However, the cam mechanism of FIG. 19 uses a large motor for generating sufficient torque to compress the coil springs 107, requiring that sufficient space be allocated for the motor. Further, while it is conceivable to drive the motor at a slower speed or to use a reduction gear for outputting this torque, an operation to lower the follow roller 106 with this construction requires more time. Since an independent motor is also required for driving the eccentric cam 116, there is not only an increase in mechanical components such as motors and transmission mechanisms, but also an increase in control circuits required for controlling the motors, thereby increasing the scale of the device and leading to a more complex circuit structure. Further, use of motors and reduction gears generates noise.

In contrast, in the image recording apparatuses according to the aspects described above, the pinch roller holder 62 automatically pivots out of the conveying path 23 when the rotating direction of the drive roller 47 is switched for conveying the recording paper S in reverse. Accordingly, the recording paper S can be smoothly conveyed in reverse onto the reverse conveying path 56 without providing a separate motor or the like. Thus, the above-mentioned problems of the comparative examples do not occur.

What is claimed is:

1. An image recording apparatus comprising:

a main body formed with a conveying path along which a recording medium is conveyed;

an image recording unit that records an image on the recording medium at an image recording position; and a conveying device that conveys the recording medium to the image recording position, the conveying device comprising:

a drive roller that is rotatable about a rotational axis;

a follow roller in pressure contact with the drive roller;

an urging member that applies pressure to the follow roller for pressing the follow roller against the drive roller;

a bearing member that supports the urging member and that rotatably supports the follow roller;

a pivoting support member that supports the bearing member such that the bearing member is pivotally movable about either one of the rotational axis and another axis different from the rotational axis; and a driving unit that pivotally moves the pivoting support member and the bearing member between a first position at which the follow roller is located on a side of the conveying path opposite to the drive roller for conveying the recording medium, and a second position at which the follow roller is located on a same side of the conveying path as the drive roller, such that the follow roller is retracted from the conveying path.

2. The image recording apparatus according to claim 1, wherein the pivoting support member extends from the bearing member toward the drive roller and rotatably supports the drive roller; and wherein the driving unit comprises:

a drive source that supplies the drive roller with a rotational force; and a switch control unit that controls the drive source to switch a rotational direction of the drive roller.

3. The image recording apparatus according to claim 1, wherein the follow roller comprises a plurality of follow rollers; and wherein the bearing member integrally supports the plurality of follow rollers at predetermined intervals along a direction parallel to the rotational axis.

4. The image recording apparatus according to claim 1, wherein the conveying path includes a reverse conveying path for inverting the recording medium conveyed in reverse and guiding the recording medium to the image recording position in an inverted orientation when a rotational direction of the drive roller is switched to a reverse direction.

5. The image recording apparatus according to claim 1, wherein the conveying path includes a retracting path for receiving at least one of a storage medium and a media tray holding the storage medium that is conveyed in reverse when a rotational direction of the drive roller is switched to a reverse direction.

6. The image recording apparatus according to claim 1, wherein the bearing member extends in a longitudinal direction parallel to the rotational axis and has a substantially U-shaped cross section;

wherein the bearing member is formed with a roller-accommodating compartment and an urging-member-accommodating compartment both of which confront the drive roller;

wherein the follow roller is accommodated in the roller-accommodating compartment; and wherein the urging member is accommodated in the urging-member-accommodating compartment in a compressed state.

7. The image recording apparatus according to claim 6, wherein the roller-accommodating compartment comprises a plurality of roller-accommodating compartments formed at predetermined intervals along the longitudinal direction of the bearing member; and wherein the urging-member-accommodating compartment comprises a plurality of urging-member-accommodating compartments formed adjacent to and on both ends of each of the plurality of roller-accommodating compartments.

8. The image recording apparatus according to claim 6, wherein the urging-member-accommodating compartment is defined by partitioning plates erected on both longitudinal sides of the urging-member-accommodating compartment; and wherein a bearing is formed as a groove in each partitioning plate such that a rotational shaft of the follow roller is capable of moving in the bearing in directions toward and away from the drive roller.

9. The image recording apparatus according to claim 1, wherein the bearing member extends in a longitudinal direction parallel to the rotational axis and has a substantially U-shaped cross section; and wherein the pivoting support member includes:

a gripping part formed with a through-hole into which a rotational shaft of the drive roller is inserted, thereby rotatably supporting the rotational shaft of the drive roller; and an insertion part that is inserted into a U-shaped groove formed in the bearing member and that is fixed to the bearing member.

10. The image recording apparatus according to claim 1, wherein the main body has a first restricting part and a second restricting part;

wherein, when the drive roller is driven to rotate in a first rotational direction, the bearing member is pivotally moved in a first direction until contacting the first restricting part, the first restricting part restricting further pivotal movement of the bearing member in the first direction and maintaining the bearing member in the first position; and wherein, when the drive roller is driven to rotate in a second rotational direction, the bearing member is pivotally moved in a second direction until contacting the second restricting part, the second restricting part restricting further pivotal movement of the bearing member in the second direction and maintaining the bearing member in the second position.

11. The image recording apparatus according to claim 10, further comprising a platen disposed in confrontation with the image recording unit, wherein the first restricting part is disposed at a position for maintaining the bearing member such that a line segment connecting an axial center of the drive roller and an axial center of the follow roller slopes slightly from a vertical direction, allowing the recording medium to be pressed against the platen and prevented from rising off the platen.

12. The image recording apparatus according to claim 1, wherein the either one of the rotational axis and the another axis is located on the same side of the conveying path as the drive roller.

* * * * *